US005406900A

United States Patent [19]

Schramayr et al.

[11] Patent Number: 5,406,900

[45] Date of Patent: * Apr. 18, 1995

[54] METHOD AND APPARATUS FOR ATTACHING SLEEVES TO TUBULAR SHIRT BODIES

[75] Inventors: Ernst Schramayr, Barneveld; Tadeusz A. Olewicz, Clinton, both of N.Y.

[73] Assignee: Jet Sew Technologies, Inc., Bowling Green, Ky.

[ * ] Notice: The portion of the term of this patent subsequent to Sep. 27, 2011 has been disclaimed.

[21] Appl. No.: 130,358

[22] Filed: Oct. 1, 1993

Related U.S. Application Data

[63] Continuation-in-part of Ser. No. 62,127, May 14, 1993.

[51] Int. Cl.[6] ..... D05B 3/12

[52] U.S. Cl. ..... 112/265.1; 112/2; 112/104; 112/262.3

[58] Field of Search ..... 112/265.1, 262.2, 262.3, 112/2, 121.12, 121.15, 121.14, 63, 104

[56] References Cited

U.S. PATENT DOCUMENTS 4,915,040 4/1990 Sakuma et al. ..... 112/63 X 4,957,054 9/1990 Sakuma et al. ..... 112/63 X

*Primary Examiner*—Clifford D. Crowder

*Assistant Examiner*—Paul C. Lewis

*Attorney, Agent, or Firm*—Schweitzer Cornman & Gross

[57] ABSTRACT

A method and apparatus are disclosed for automating the sewing of tubular sleeve sections onto tubular shirt bodies, as in the manufacture of T-shirts. Shirt bodies and sleeve sections are applied over a generally cylindrical body form having portions aligned with the sleeve openings of the shirt body. In one version, the sleeve sections are applied inside-out and inner end first over opposed hollow sleeve cones. The areas of the shirt body surrounding the sleeve openings are engaged at spaced points by positioning devices, which independently position segments of the sleeve opening edges with respect to predetermined reference planes. Thereafter, tubular sleeve sections are applied axially over the body form, in surrounding relation to the shoulder areas of the shirt body. As segments of the sleeve inner edges approach the reference planes, individual segments are engaged and retained in position, until all portions of the sleeve edges are aligned with their respective reference plane. The alignment means are then withdrawn and the body form is indexed to a sewing station, where each end of the body form is approached in succession by a sewing machine, which is rotated about an axis aligned with the body form, following a circular path to sew the sleeve edges to the edges of the sleeve opening. In another version, the sleeve openings and sleeve edges are aligned manually by the operator, as part of the operations of loading the body and sleeves onto the body form.

20 Claims, 18 Drawing Sheets

FIG.10
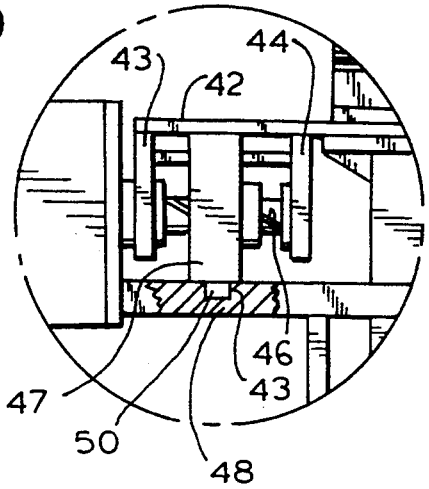
FIG.8
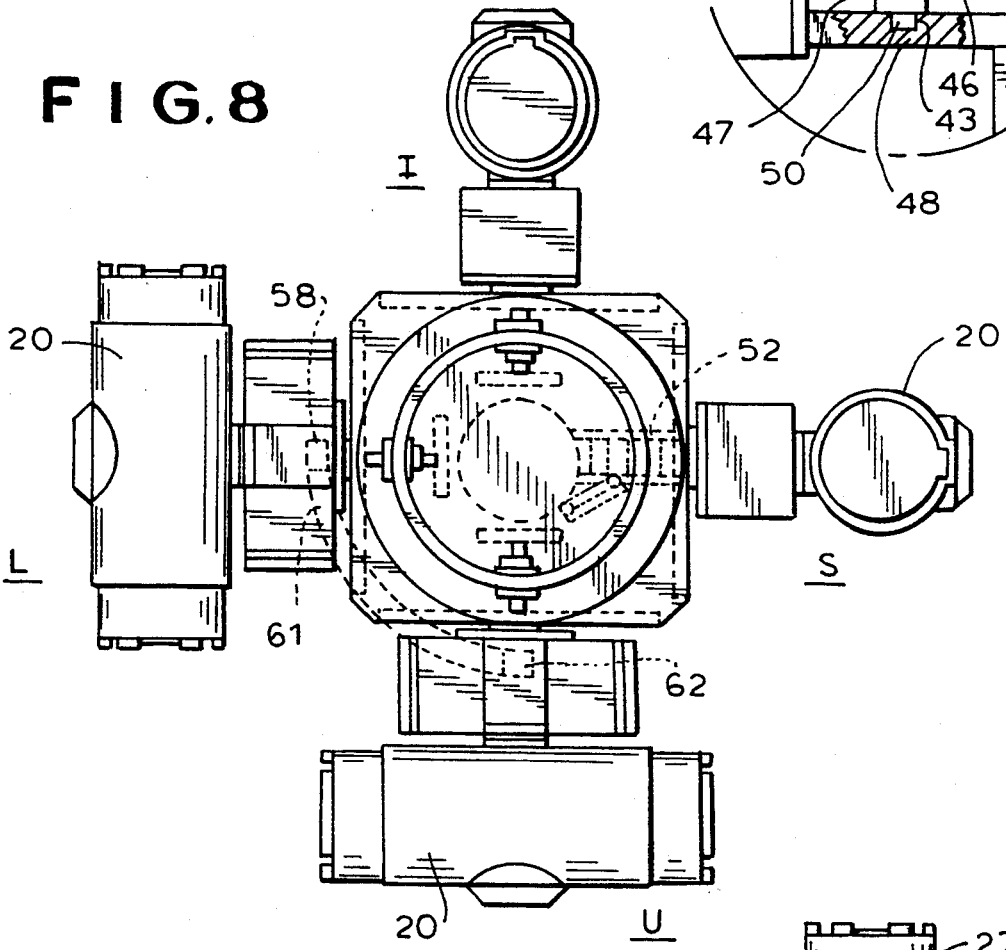
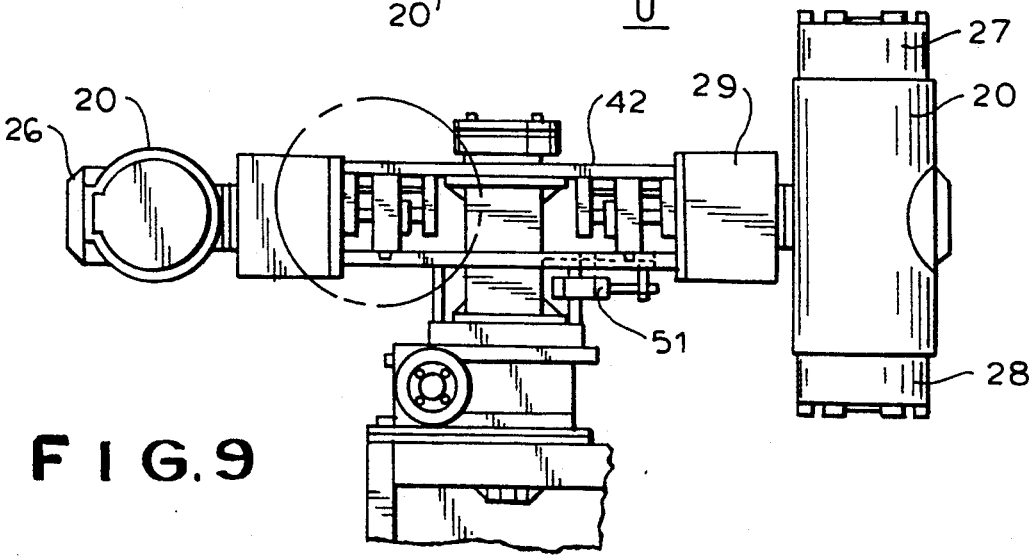
FIG.9

FIG.13
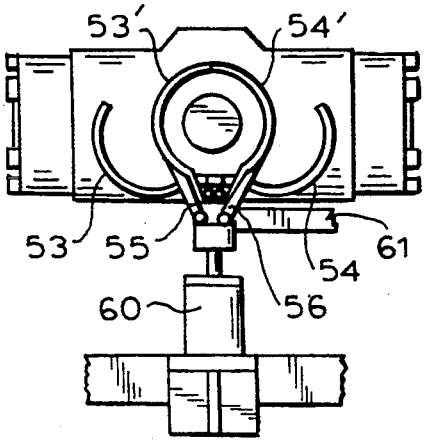
FIG.11
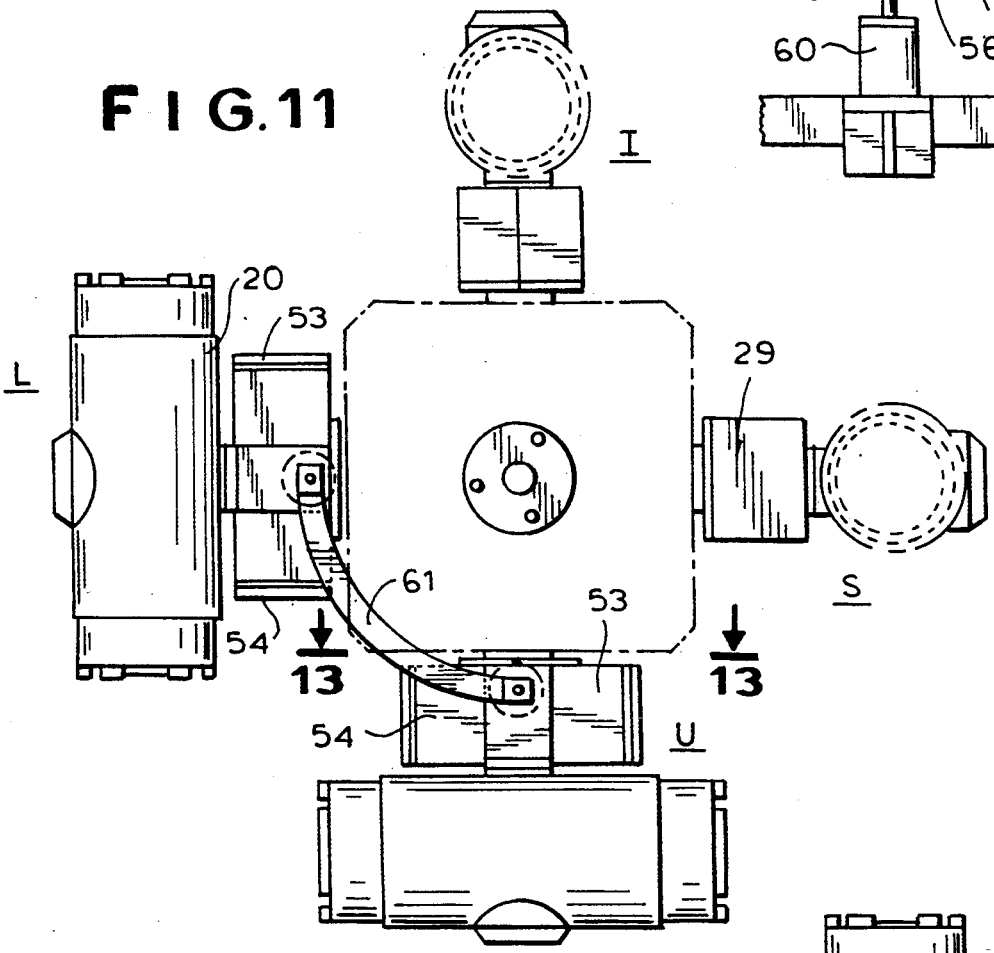
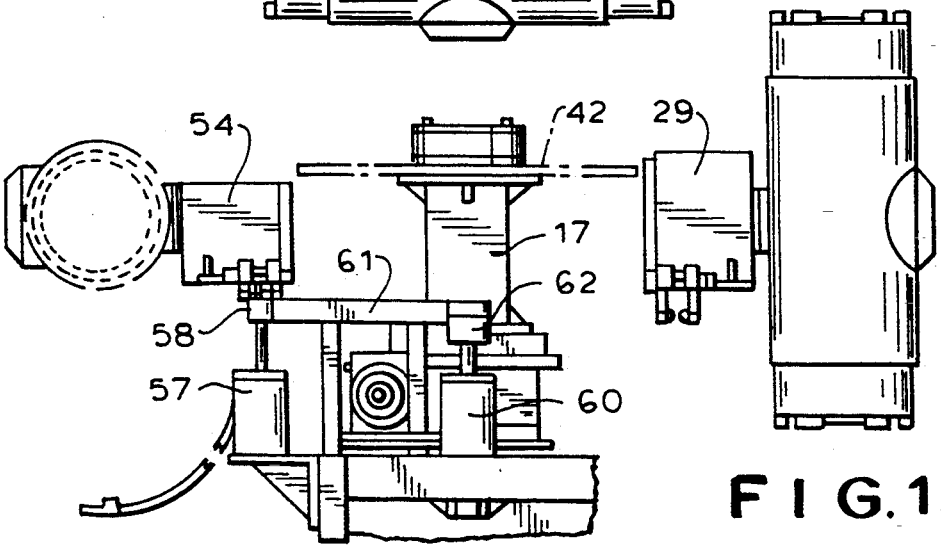
FIG.12

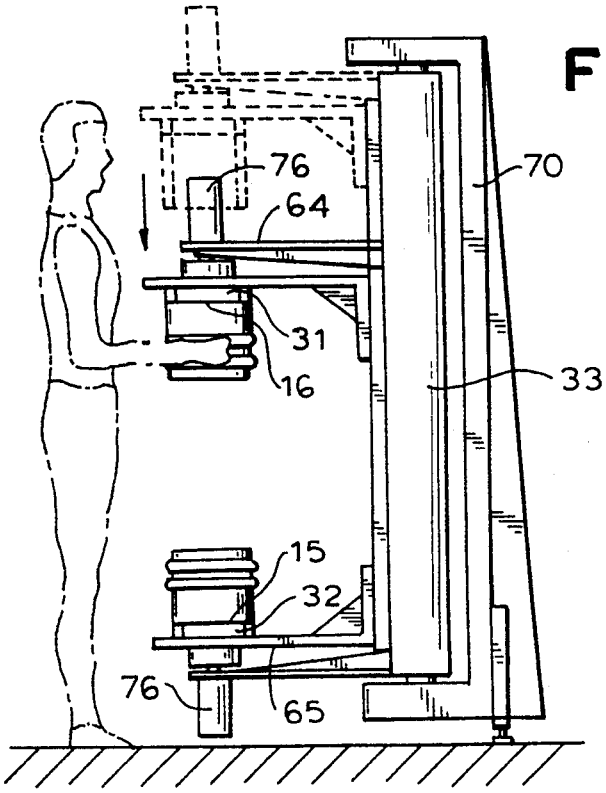
FIG. 18
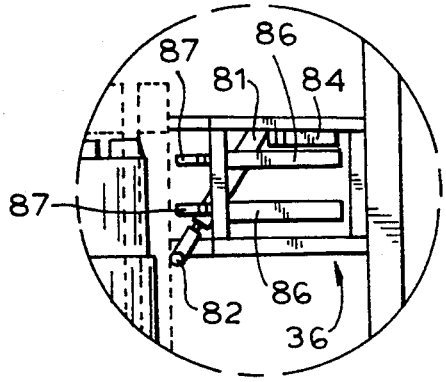
FIG. 23
FIG. 22
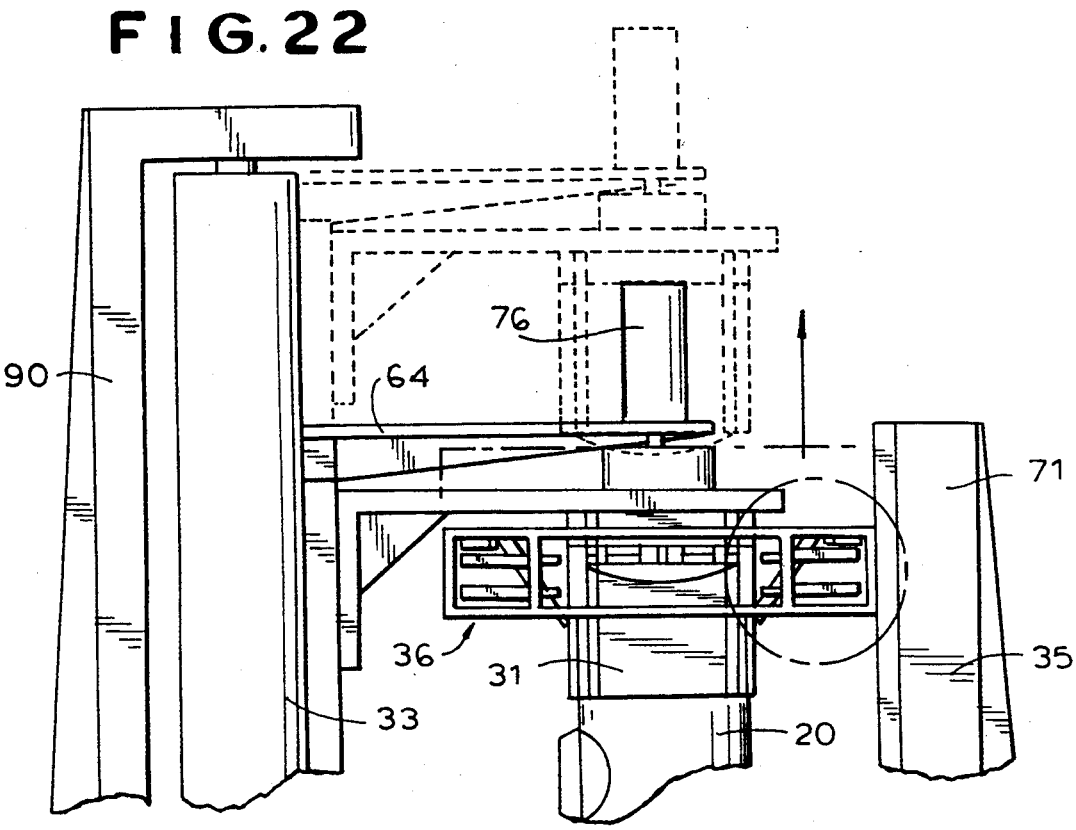

FIG. 19
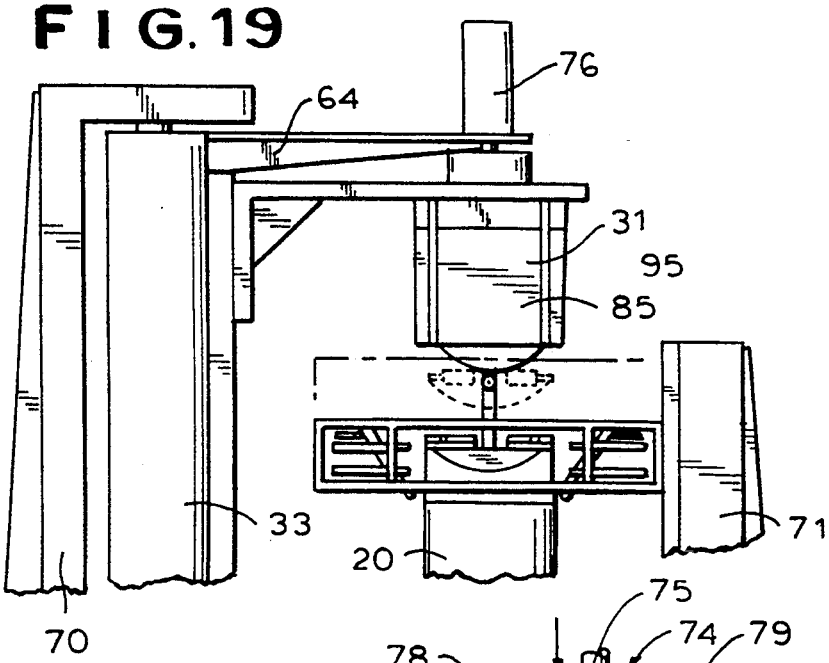
FIG. 20
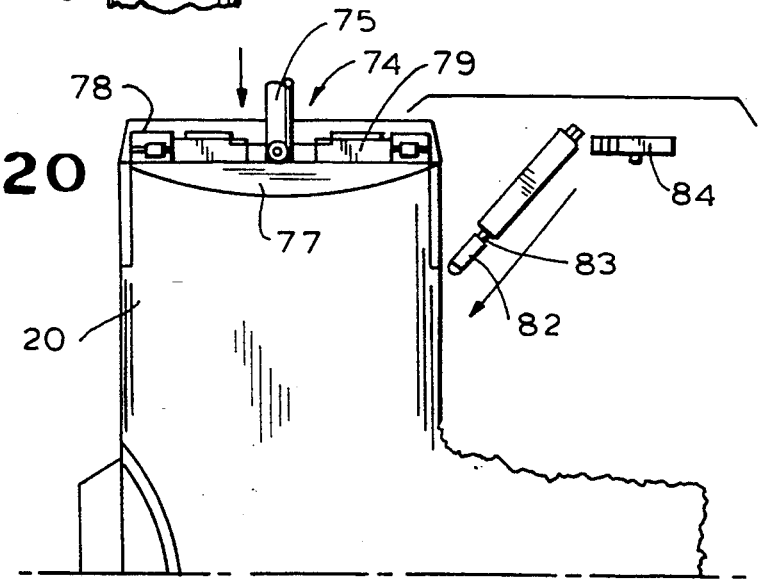
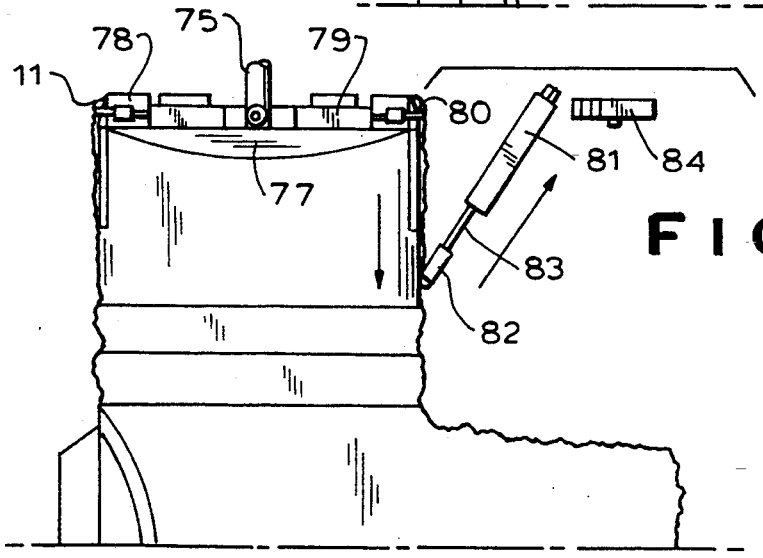
FIG. 21

METHOD AND APPARATUS FOR ATTACHING SLEEVES TO TUBULAR SHIRT BODIES

RELATED APPLICATIONS

This application is a continuation-in-part of our copending application Ser. No. 062,127, filed May 14, 1993.

BACKGROUND AND SUMMARY OF THE INVENTION

In the manufacture of T-shirts, one of the labor-intensive and relatively costly operations has been that of attaching tubular sleeve sections to the sleeve openings in tubular shirt bodies. The process involves either inserting the sleeve section into the shirt body, through the sleeve opening, or applying the sleeve section over the exterior of the shirt body, effecting desired alignment of the respective edges of the sleeve and sleeve opening, and sewing the thus aligned elements. Attempts have been made in the past to introduce various degrees of automation to the sleeve installation process, but so far none has been altogether satisfactory.

The present invention is directed to apparatus and a procedures for substantially automating the sleeve attachment procedure, preferably employing a multi-station indexing turret mechanism which enables a single operator to sequentially load individual tubular shirt bodies onto and sleeve sections onto a body form. Pursuant to the invention, an operator located at a predetermined load station of the multi-station mechanism sequentially applies individual sleeve sections and shirt bodies to a body form mechanism provided at each position of the indexable multi-station apparatus. In certain forms of the invention, automated mechanisms are provided for effecting desired alignment of sleeve edges with the sleeve openings in the shirt body. In other forms of the invention, the operator effects the desired alignment manually. In either case, the mounting and alignment of the sleeve sections and shirt body on the body form is followed by automatic sewing of the sleeve sections to the shirt body in a rapid and efficient manner.

In a first-described form of the invention, an operator loads individual shirt bodies onto a body form and individual tubular sleeve sections onto special sleeve-loading cones. In a four-station turret system, the mechanism is indexed from the loading station to a sleeve installing station, where the sleeve-loading cones are manipulated to apply the individual sleeve sections to the shirt body. At this station, novel and advantageous mechanisms are provided for aligning the edges of the sleeve openings with a predetermined reference plane, and thereafter aligning the inner edges of the respective sleeve sections with respect to the same reference plane. In the next index position of the system, the aligned edges are sewn together, and this is accomplished advantageously by a sewing machine mounted in vertical orientation on a rotatable platform. The sewing machine is elevated to a position aligned with the beforementioned reference plane and then advanced through a circular path by rotation of the sewing machine platform, in order to complete the attachment of sleeve section to shirt body. At the sewing station, the entire shirt body form, with the assembled and aligned sleeve sections, can be rotated through 180°, so that both sleeve sections are secured to the shirt body in successive sewing operation at the same station.

Following the sewing operation, the mechanism is indexed to bring the shirt body, with its now-attached sleeve sections, to an unloading station. At this station, the sleeve sections, which are oriented inside-out for sewing, are pulled out and reversed, and the completed shirt body is pulled off of the body form and placed on a stack of finished goods.

In the system and apparatus of the first-described form of the invention, the duties of the operator are limited to loading and approximate alignment of the shirt body on the body form, and loading of individual sleeve sections over special forms, referred to herein as sleeve cones. All of the remaining procedures, including application of the sleeve sections onto the body form, alignment of the edges of the sleeve openings and alignment of the corresponding edges of the sleeve, as well as subsequent sewing together of the aligned edges, are performed automatically and in rapid sequence. While these operations are going on, the operator is loading subsequent stations of the turret with a new body forms, and reloading the sleeve cones with new sleeve sections. The system does not rely upon the operator to achieve accuracy of alignment, which is all accomplished quickly and automatically, utilizing novel mechanisms according to the invention.

In a second-described form of the invention, provision is made for the operator to load the sleeve sections onto the body form and to effect edge alignment of the sleeve forms manually. The operator then applies a shirt body over the same body form and manually aligns the edges of the sleeve opening with the edges of the sleeve sections. These initial loading and alignment operations are followed by automatic sewing in generally the same manner as the first-described embodiment. For at least certain operations, the slight additional operator time required to effect manual loading and alignment of the sleeve and body sections is adequately offset by the reduced cost and complexity of the equipment.

For a more complete understanding of the above and other features and advantages of the invention, reference should be made to the following detailed description of a preferred embodiment of the invention and to the accompanying drawings.

DESCRIPTION OF THE DRAWINGS

FIG. 8 is a top plan view of a turret mechanism employed in the apparatus of FIG. 1 showing the rotational orientation of shirt body forms in various positions of the turret.

FIG. 9 is a fragmentary side elevation, with parts broken away, of the turret mechanism of FIG. 8.

FIG. 10 is an enlarged view, with parts broken away, of a portion of the mechanism shown in FIG. 9 for effecting controlled rotation of the shirt body forms.

FIG. 11 is a top plan view of the turret mechanism of FIG. 8, illustrating features of a mechanism for opening and closing a shirt body clamp.

FIG. 12 is a side elevational view, with parts broken away, of the mechanisms shown in FIG. 11.

FIG. 13 is a cross sectional view as taken generally on line 13—13 of FIG. 11, showing additional details of a clamp operating mechanism.

FIGS. 17 and 18 are side elevational views illustrating the manner in which an operator loads sleeve sections onto upper and lower sleeve-loading cones of the apparatus.

FIG. 19 is an enlarged fragmentary elevational view showing the sleeve loader and positioner mechanisms deployed to position a sleeve section onto the shirt body in advance of sewing.

FIGS. 20 and 21 are sequential views illustrating a mechanism for initially locating the edges of the sleeve holes of the shirt body.

FIG. 22 is a fragmentary view of the sleeve loading and aligning mechanisms.

FIG. 23 is an enlarged view of the circled portion of FIG. 22.

DESCRIPTION OF PREFERRED EMBODIMENTS OF THE INVENTION

Figure 1:
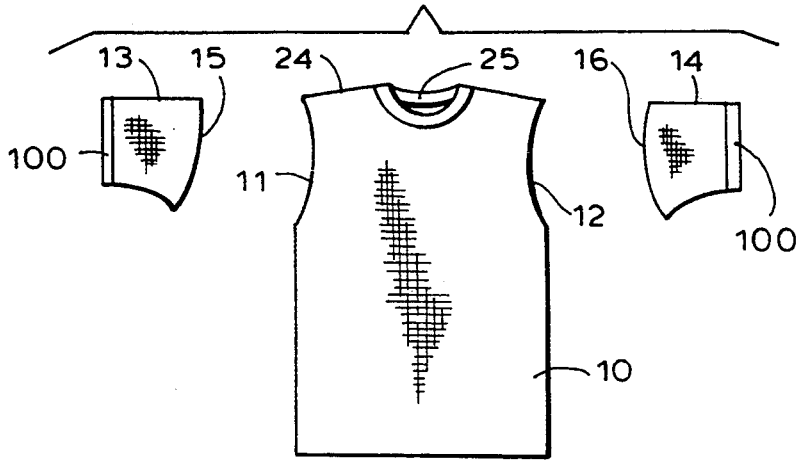
FIG. 1 is a representative exploded view showing a typical arrangement of tubular shirt body and associated tubular sleeve sections.

Referring now to the drawings, and initially to the embodiment illustrated in FIGS. 1–32, a typical shirt body 10 in tubular form and typically of tubular knitted fabric, is provided with contoured arm openings 11, 12. Tubular sleeve sections 13, 14, formed with contoured inner end edges 15, 16 are arranged to be joined with overlapping edge margins at the sleeve openings 11, 12 and secured by sewing. The task of installing the sleeve sections is complicated by the fact that the contoured sleeve edges must be overlapped and aligned with the contoured edges of the sleeve openings, and then maintained in such alignment while the parts are progressively sewn together. The apparatus and equipment of the present invention make it possible to perform this on a substantially automated basis.

Figure 3:
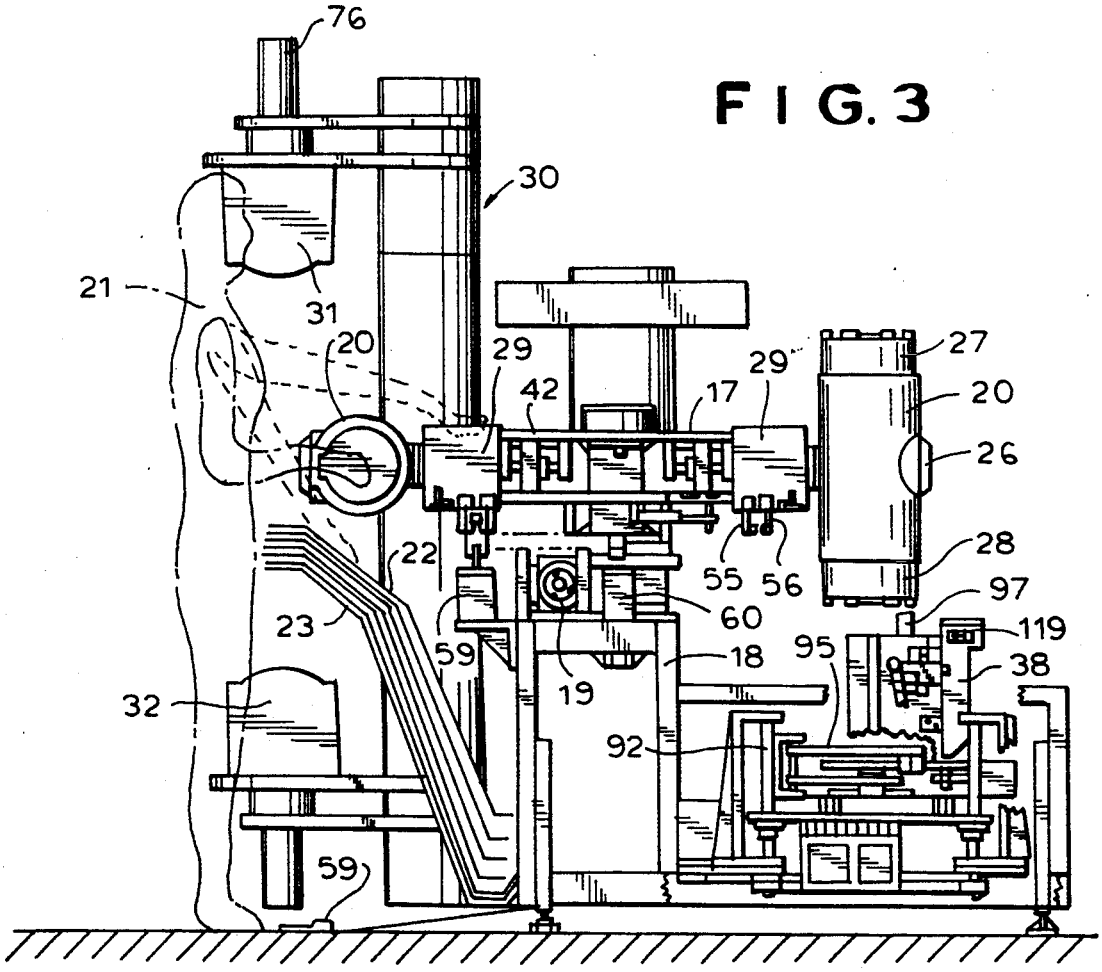
FIG. 3 is a side elevational view of the apparatus of FIG. 2.
Figure 2:
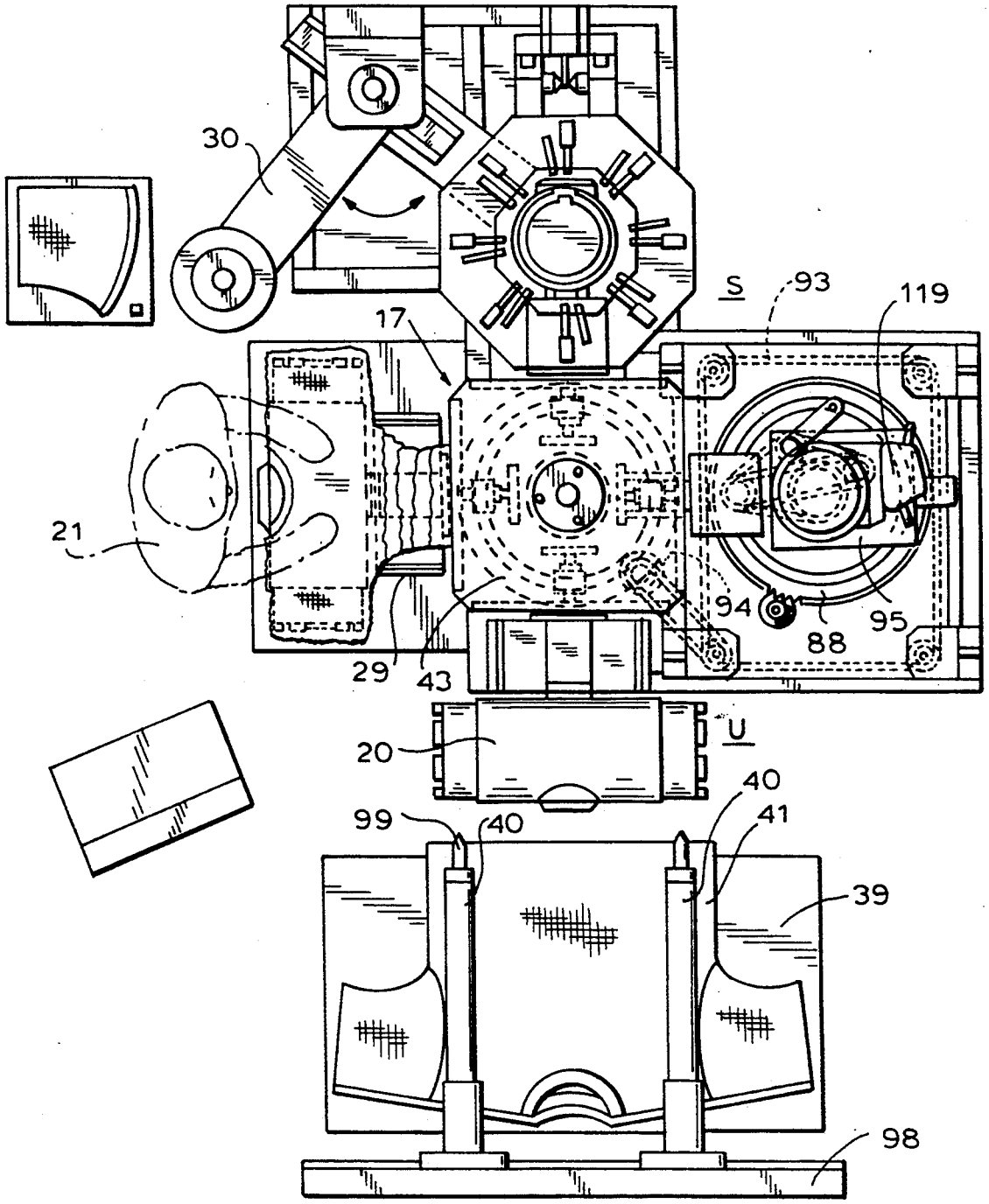
FIG. 2 is a top plan view of an apparatus according to one embodiment of the invention for automating the attachment of tubular sleeve sections to tubular shirt bodies.
Figure 4:
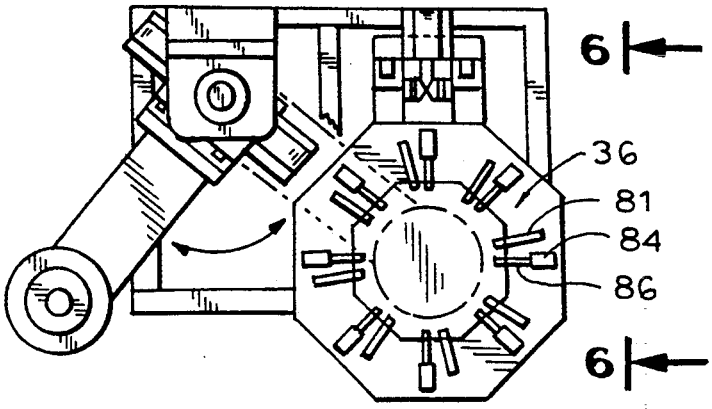
FIG. 4 is a top plan view of a sleeve-leading section of the apparatus of FIGS. 1 and 2.
Figure 7:
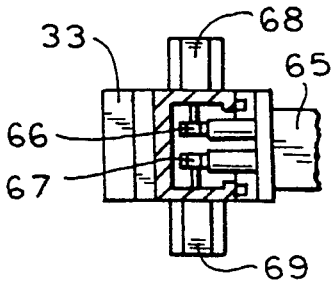
FIG. 7 is a fragmentary cross sectional view as taken generally on line 7—7 of FIG. 5.

With reference to FIGS. 2 and 3, the apparatus includes a four-position, indexable turret 17, mounted on a base 18 and arranged by a suitable drive mechanism 19 to be indexed through increments of, in the illustrated machine, 90°.

Each of the four-index stations of the turret mechanism is provided with a generally cylindrical shirt body form 20, each mounted for rotation between horizontal and vertical orientations.

OVERVIEW OF OPERATION

As a brief overview of the operation of the equipment of FIGS. 1–32, an operator 21, standing at a predetermined load station L of the indexable turret picks up individual tubular shirt bodies 22 from a supply rack 23 and places the shirt body, tail-first and outside-out, over the cylindrical body form 20 until the "shoulders" 24 (FIG. 1) of the shirt body are seated against the body form 20, and the neck portion 25 of the shirt body is positioned over a projecting alignment boss 26. The sleeve openings of the shirt body at this juncture are roughly aligned with the opposite end portions 27, 28 of the body form. The fabric edges at the sleeve openings 11, 12 project slightly beyond the ends of the body form.

After thus positioning the shirt body, the operator closes a cylindrical clam shell clamp 29, which gathers up body material in the tail portion of the shirt body and serves as a containment for such material during subsequent operations.

Figure 17:
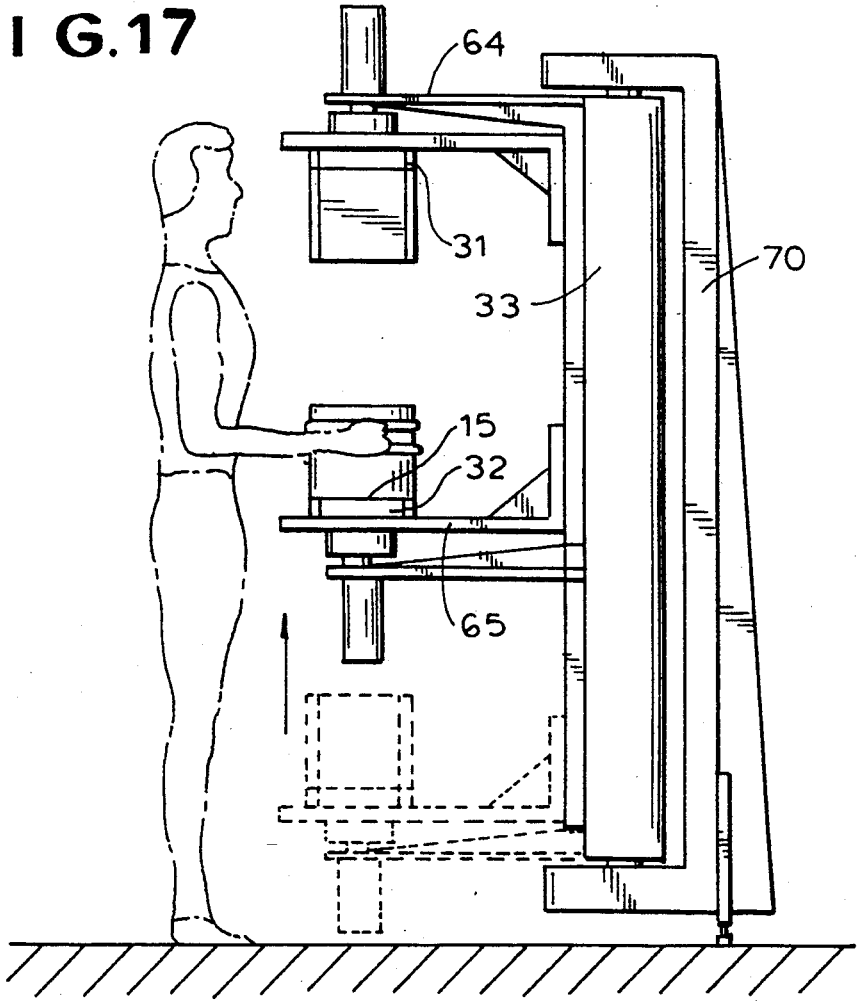
Figure 24:
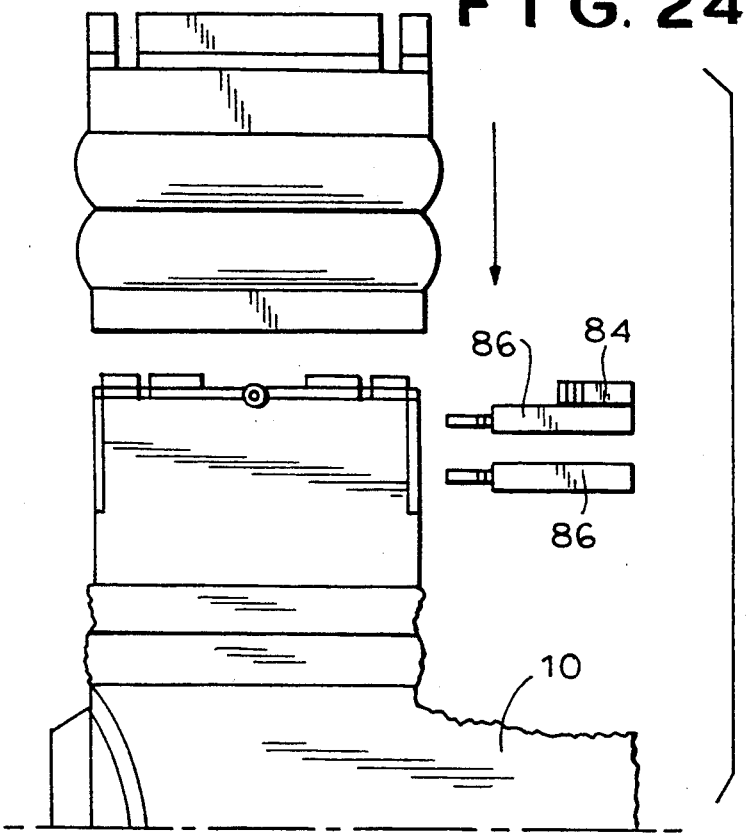
FIGS. 24 and 25 are sequential views illustrating mechanisms for proper location of the edge of a sleeve section positioned over the previously aligned shirt body.
Figure 26:
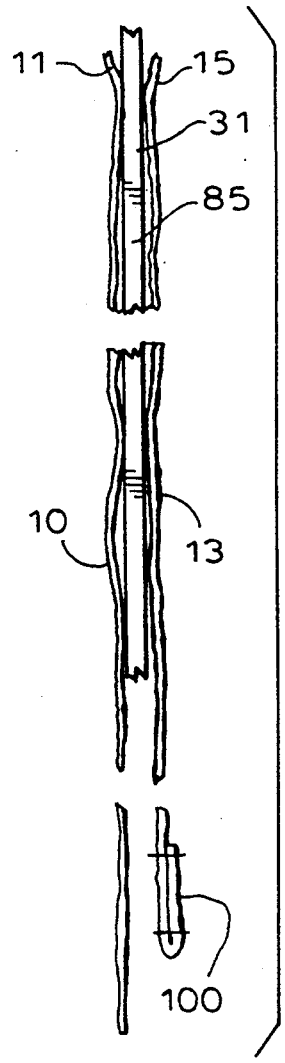
FIG. 26 is an enlarged, fragmentary, sectional view illustrating the manner of applying a sleeve section over the shirt body.
Figure 25:
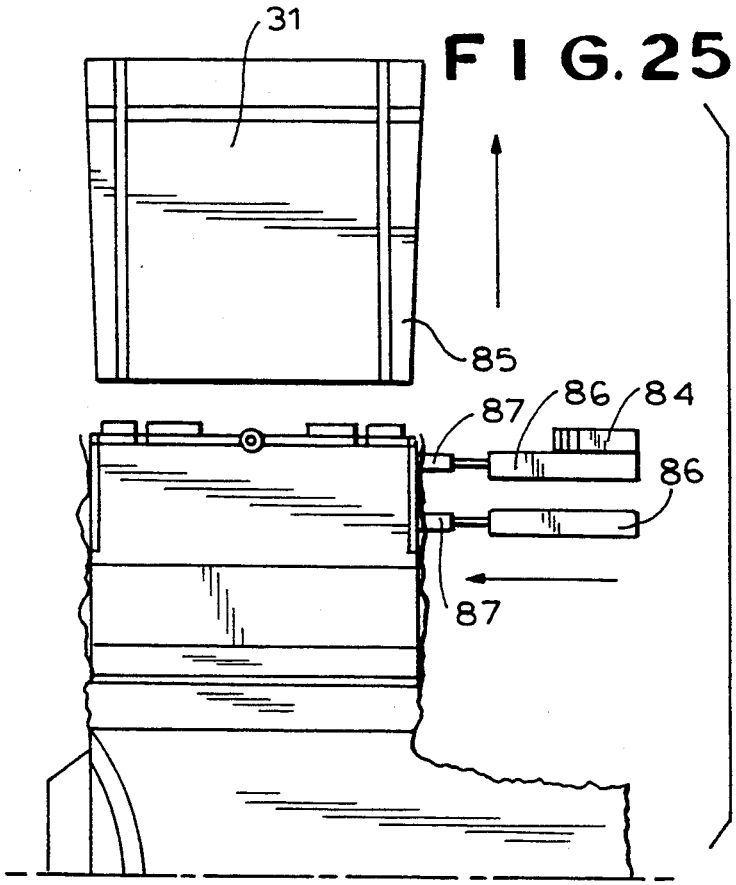
Figure 27:
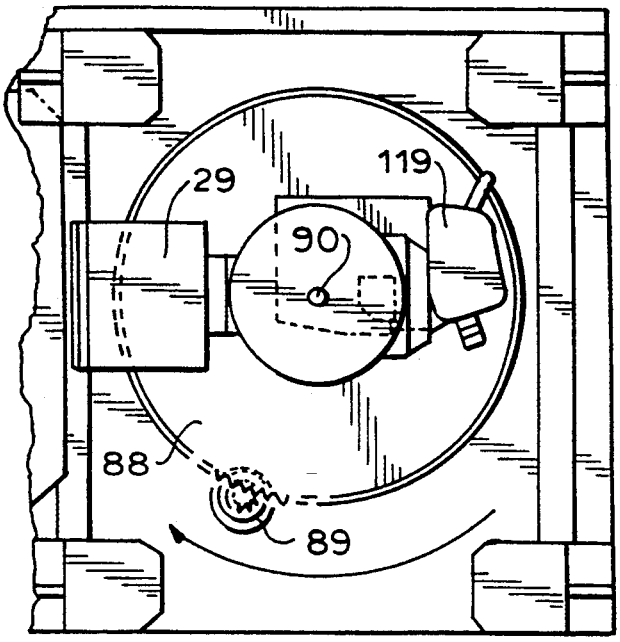
FIG. 27 is a fragmentary top plan view showing features of the sewing machine platform.
Figure 28:
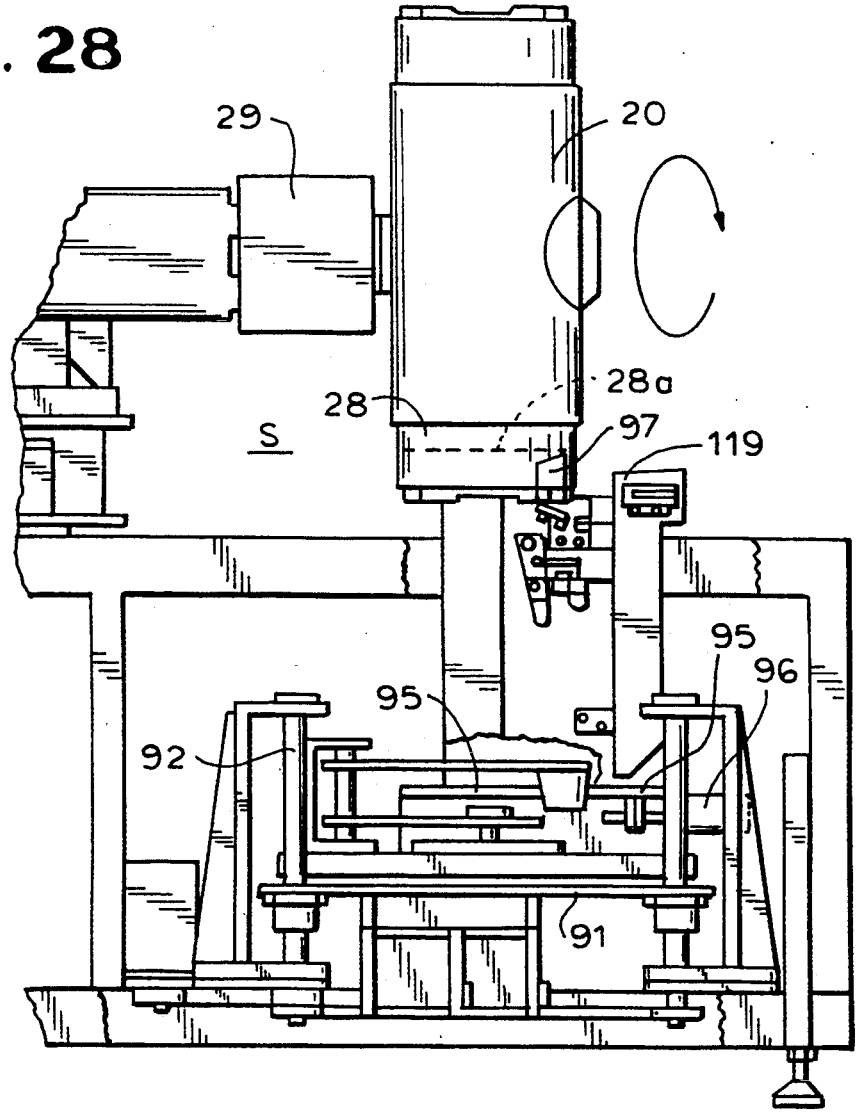
FIG. 28 is a side elevational view illustrating the association of the sewing machine with a shirt body form at the time of sewing.
Figure 29:
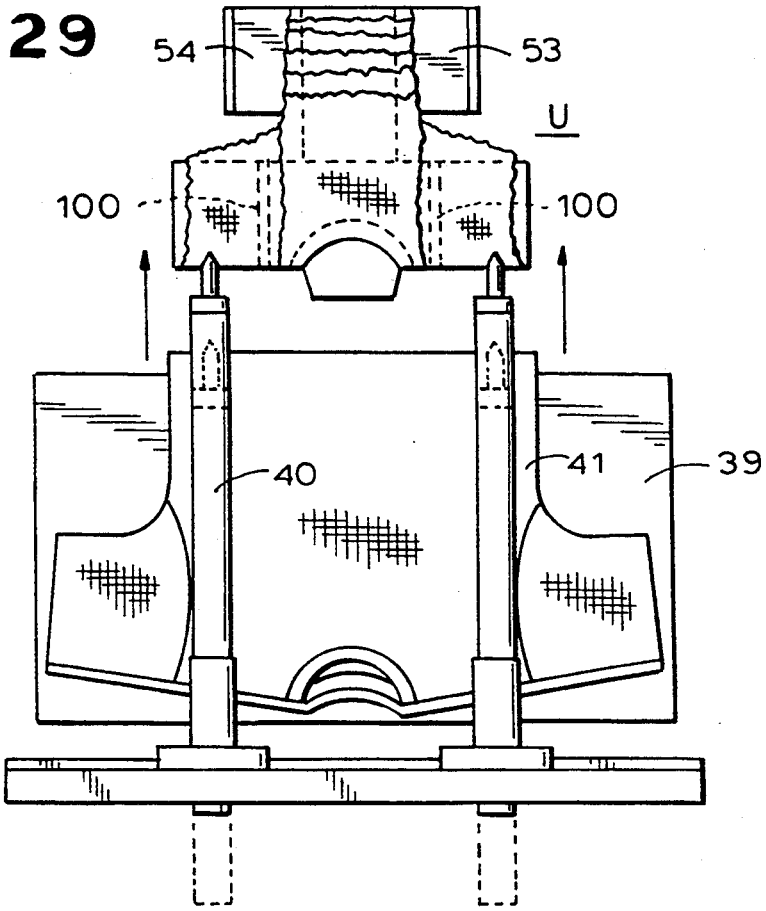
FIGS. 29 and 30 are sequential views illustrating the manner of gripping and removing a completed shirt at the unloading station of the turret system.
Figure 30:
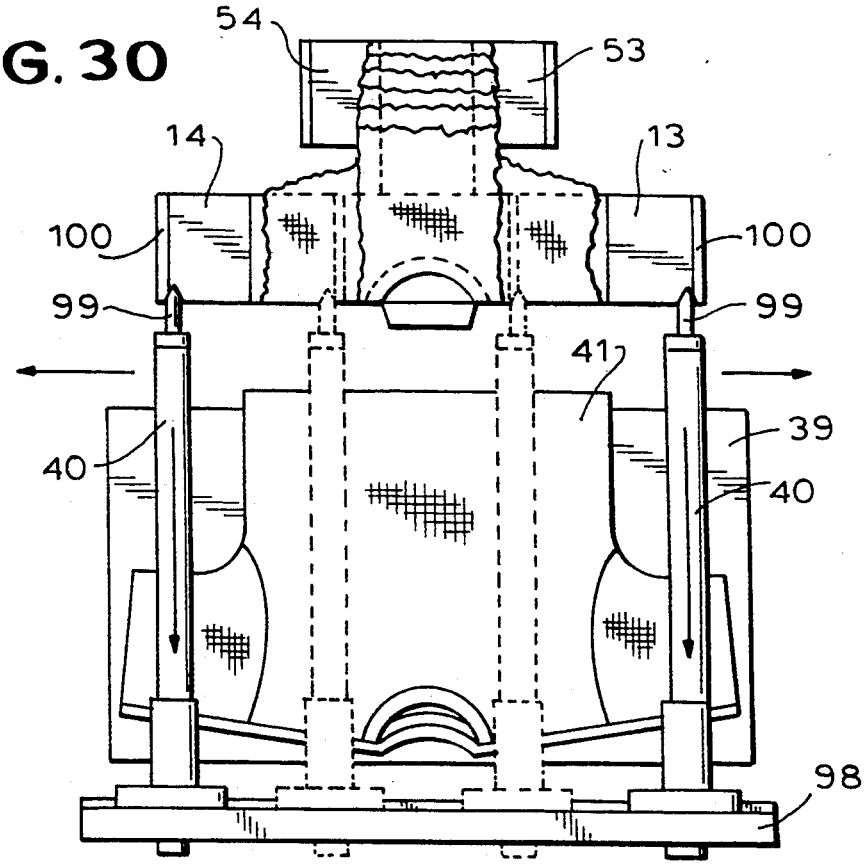

Having thus positioned the shirt body on the body form, the operator then turns to the sleeve loader 30, which is provided with upper and lower sleeve cones 31, 32, arranged to be vertically movable on a support column 33. As shown for example in FIGS. 17, 18, the lower sleeve cone is elevated to a convenient height for the operator, who selects a sleeve section 34 from a supply platform 35, and applies the sleeve section, contoured end first, over the upraised lower sleeve cone 32 (FIG. 17). Next, the upper sleeve cone is lowered to a convenient height (FIG. 18) and the operator selects another sleeve section 34 from the platform 35 and applies it, contoured end first, over the upper sleeve cone 31. The sleeve sections 34, as initially supplied at the platform 35, have an inside-out orientation and are applied to the respective sleeve cones 31, 32 in such inside-out orientation.

Figure 5:
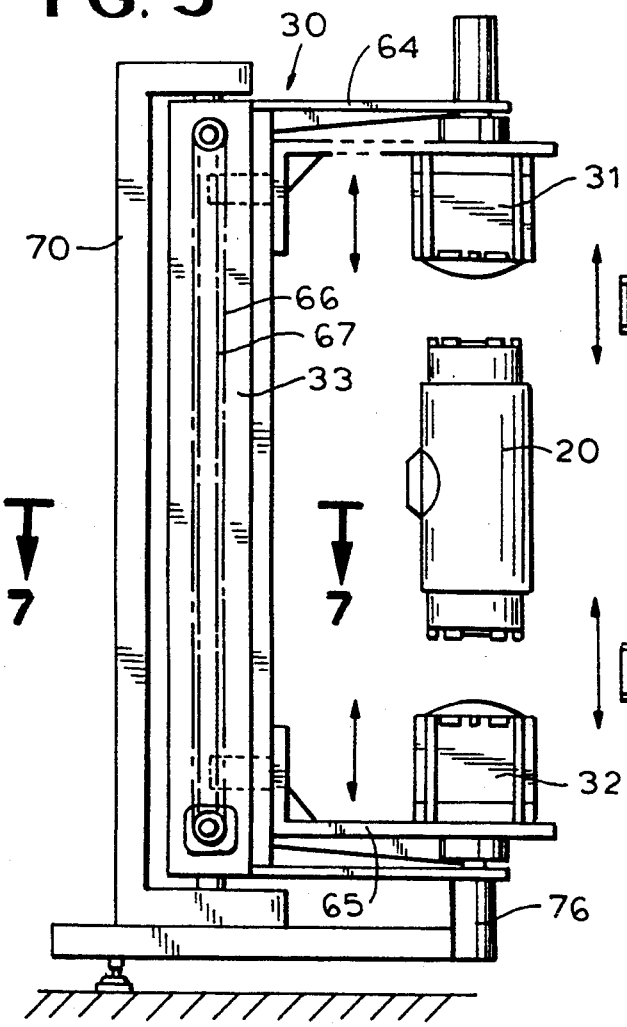
FIG. 5 is a side elevational view of the sleeve-loading station of FIG. 4, with the sleeve-loading heads separated.
Figure 6:
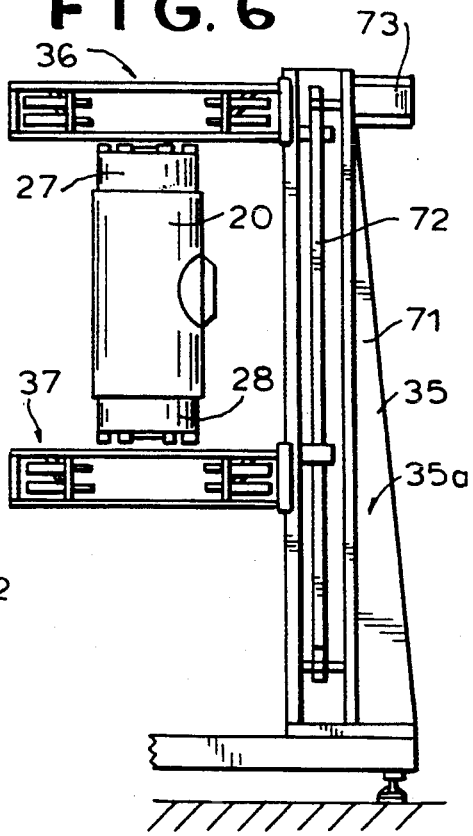
FIG. 6 is a side elevational view looking generally in the direction of arrows 6—6 of FIG. 4, illustrating mechanisms for aligning the edges of sleeve sections with the edges of sleeve openings in the tubular shirt body prior to sewing.
Figure 14:
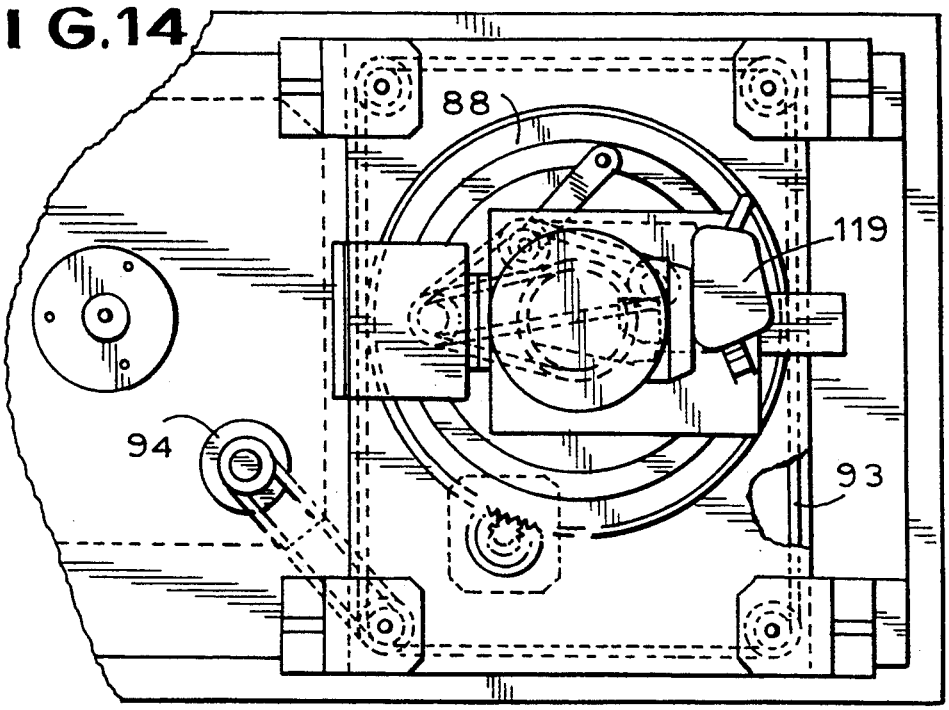
FIG. 14 is a fragmentary top plan view showing features of a rotating sewing machine platform utilized for sewing the tubular sleeve sections to the shirt body after positioning of the sleeve sections.
Figure 15:
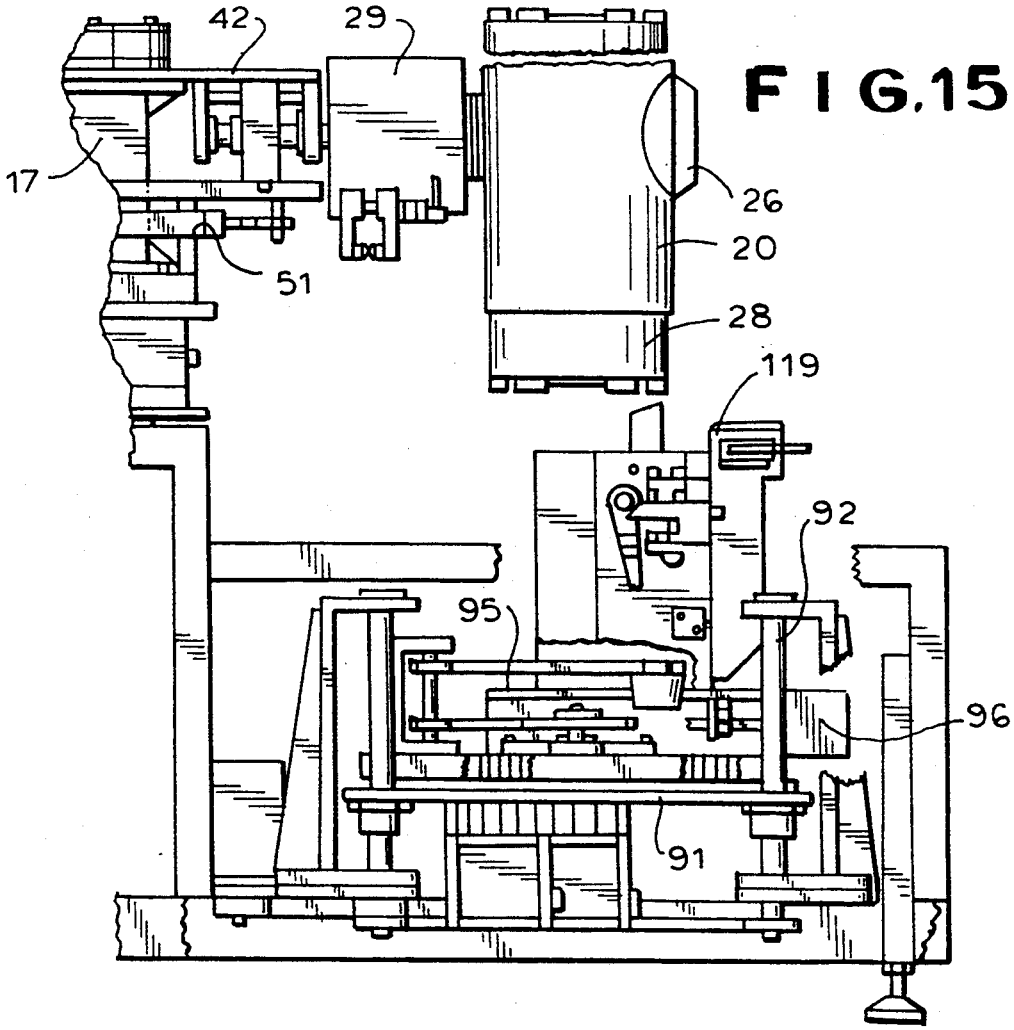
FIG. 15 is a fragmentary side elevational view showing features of the sewing machine platform.

While the operator is performing the sleeve loading operation, the turret is indexed 90° in a clockwise direction, to a sleeve inserting station I. During the indexing movement, the loaded body form is rotated 90° about its support axis, so that the body form is vertically oriented (FIG. 5). Once both sleeves are loaded the cones are retracted to their home positions. The sleeve cone support is then pivoted to a position with the respective upper and lower sleeve cones in axial alignment with the loaded body form 20.

At the sleeve insertion station of the mechanism a vertical support 35*a* mounts upper and lower edge alignment frames 36, 37, which will be described in detail hereinafter. These frames are advanced axially over the respective end portions 27, 28 of the loaded body form and function first to align edges of the sleeve openings 11, 12 with predetermined horizontal reference planes. In addition to alignment frames, pinning ring assemblies, residing inside the cones but moving independently, are lowered into the body form.

After alignment of the sleeve opening edges with a reference plane, the edges are temporarily secured by pins. Thereafter, the upper and lower sleeve cones 31, 32 are radially expanded and caused to move axially over the ends of the body form, from opposite ends, so that the expanded sleeve sections surround the body fabric on each end of the form. In a manner to be described, the "inner" attachment edges of the sleeve sections are sensed and located by the alignment frames and held in place as the sleeve cones are retracted. The sleeve sections then contract and surround the outer portions of the body form snugly, with the attachment edges of the sleeve sections properly aligned with the edges of the sleeve openings and with respect to the predetermined reference plane.

After insertion and alignment of the sleeve sections, the sleeve cones and the alignment frames are both fully retracted and the turret 17 is indexed to the next position, which forms a sewing station S. At the sewing station, the aligned and overlapped edges are engaged by a sewing machine 38, which is supported for rotation about the axis of the body form, resulting in the aligned edges of the sleeve section and sleeve opening being sewed along the reference plane. After one sewing operation has been completed, the body form is rotated through 180°, and the operation is repeated to sew the second sleeve edge to its sleeve opening. After sewing, the turret 17 is indexed again, bringing the sewed article to an unload station U. At the unload station, the attached shirt sleeves, which are inside-out and turned over on the shoulder portions of the shirt body, are engaged by picker arms 40 and pulled laterally outward, turning the sleeves right side out and extending them outward from the sleeve openings, in a normal shirt configuration. The picker arms 40 then are manipulated to grip the completed shirt 41, pulling it off of the body form and depositing it on a finished goods rack 39.

In the first-illustrated form of the invention, the turret 17 includes a rotatable plate 42 (see FIGS. 8–10) mounting spaced shaft supports 43, 44 for each of the body forms 20. Rotatable shafts 45 extend through the supports 43, 44 and project radially outward, being fixed at their outer ends to the respective body forms 20.

As a convenient mechanism for controllably rotating the body forms 20, the support shafts 45 are provided with means, such as helical grooves 46 cooperating with slide bearings 47 which are keyed into the helical grooves and thus control the rotary position of the shafts by linear movement of the slide bearings along the axis of the shaft. In the illustrated apparatus, a fixed lower plate 48 is provided with a contoured cam groove 49 which engages a cam follower pin 50 carried by the slide bearing. When the upper turret plate 42 is indexed, to advance a body form 20 from the load station L to the sleeve insertion station I, the contours of the cam groove 49 cause the slide bearing 49 to be displaced radially and thus cause the shaft 49 and its attached body form 20 to be rotated 90°, reorienting the body form from horizontal to vertical.

When the turret is indexed to bring a body form from the sleeve insertion station I to the sewing station S, the body form remains vertical, and this is achieved by configuring the cam groove 49 for a constant radius over that 90° arc. At the sewing station it is necessary, between sewing operations, to rotate the body form through 180°. This is accomplished by means of an actuator 51 which controllably displaces a movable cam section 52 (FIG. 8), and with it the slide bearing 47, a sufficient distance to cause a 180° rotation of the helical groove shaft 45. During the next indexing operation of the turret, in which a body form is advanced from the sewing station S to the unload station U, the contours of the cam groove 49 are such as to rotate the body form 20 back to its original horizontal orientation.

The clam shell clamp mechanism 29, shown particularly in FIGS. 11–13, includes opposed semi-cylindrical clamping sections 53, 54 which are pivoted on the turret frame for opening and closing movements. In FIG. 13, the open position of the clamp is indicated by the reference numerals 53, 54, and the closed position by the reference numerals 53', 54'. The open or closed position of the clamping elements is controlled by cam arms 55, 56, which are actuated to open the clamp sections, with suitable spring means (not shown) being employed for closing the clamp.

As reflected in FIG. 11, when a body form 20 is at the load station L, the clamp sections 53, 54 are open, in order to receive the excess material from a shirt body loaded onto the body form. For this purpose, an actuator 57 is positioned at the load station and carries a cam block 58 at the end of its operating rod. When the actuator 57 is extended, the clamp actuating arms 55, 56 resting thereon are held in an upwardly displaced position to retain the clamp sections 53, 54 open. After the operator has loaded the shirt body onto the body form, and gathered the excess shirt material into the open clamp sections, he or she operates a foot switch 59 (FIG. 3) to retract the actuator and allow the clamp sections to close around the fabric. The clamp sections are retained in their closed positions by previously mentioned spring means as the turret advances the loaded body form successively to the sleeve insertion station I, the sewing station S, and the unload station U.

When the body form arrives at the unload station, an actuator 60 (FIG. 13) is automatically actuated upwardly, to displace the clamp arms 55, 56 and cause the clamp sections 53, 54 to open. During the next indexing movement of the turret, the just-displaced clamp arms are retained in their upwardly displaced positions by means of an arcuate cam track 61, which extends from the unload station to the load station, and joins with the actuator supported cam block 58 at the load station. The actuator 60 is automatically retracted as the indexing operation occurs, so that the cam block 62, operated by the actuator 60, is in a retracted position to receive the next set of clamp arms. Likewise, the actuator 57 is automatically extended, so that the cam block 58 is in a position to support the arms 55, 56 and maintain the clamp sections in an open condition.

With particular reference now to FIGS. 4–7 and 16–27, showing features of the sleeve insertion system, the upper and lower sleeve cones 31, 32 are mounted on cantilever arms 64, 65 slideably mounted on the support 33. Each of the supports is secured to a chain or belt 66 and 67 driven independently by motors 68, 69 such that the sleeve cones can be independently positioned vertically along the support column 33.

Figure 16:
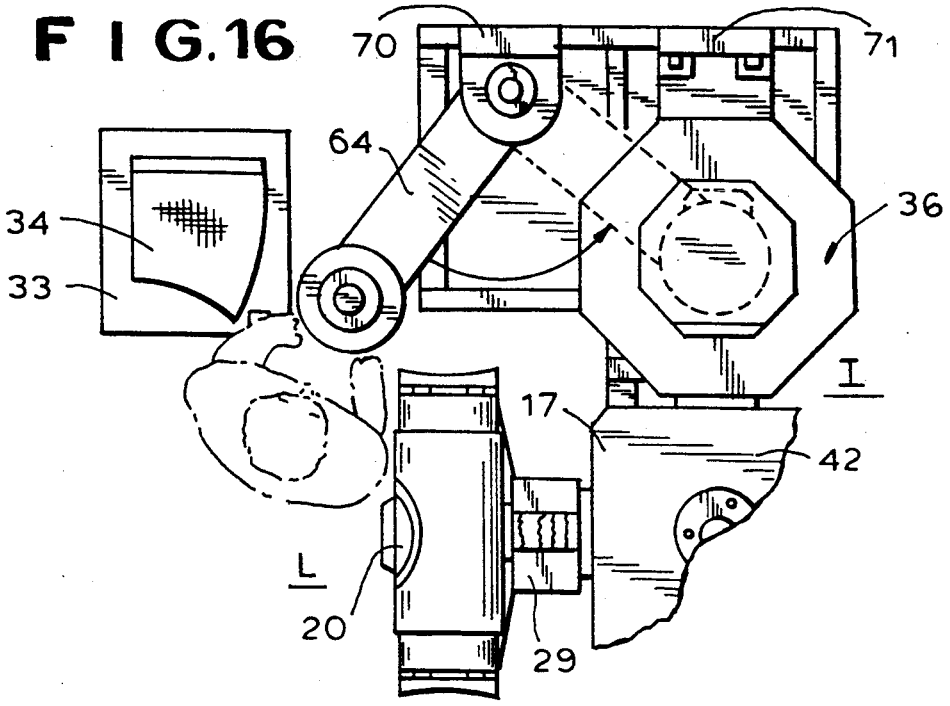
FIG. 16 is a fragmentary top plan view showing an operator loading a machine station with a shirt body and sleeve sections.

After loading a shirt body on a body form 20 at the loading station, the operator turns to the sleeve loader 30. As shown in FIG. 16, the sleeve loader includes a fixed, vertically disposed mounting member 70 which pivotally mounts the vertical support 33 and the cantilever arms 64, 65 for pivoting movement between a load position, shown in full lines in FIG. 16, and an insertion position, shown in broken lines in FIG. 16. When the sleeve loader is in the load position, the operator has available switches (not shown) for raising and lowering the sleeve cone brackets 64, 65. He also has available to him a supply of inside-out oriented sleeve sections 34, on a supply platform 35. Initially, the operator raises the lower sleeve cone bracket 65 to a comfortable position, grasps a sleeve 34 from the supply stack and applies it over the lower sleeve cone 32, generally as shown in FIG. 17. The sleeve section is applied to the cone so that the contoured edge 15 of the sleeve section is applied first, and the hemmed or outer edge of the sleeve section goes last over the cone.

After applying the first sleeve section, the operator lowers the bracket 65 back to its original home position, and simultaneously causes the upper cantilever arm to be lowered to a comfortable working position. The operator then grasps a second sleeve section and applies it upwardly over the upper sleeve cone 31, again with the contoured edge 16 applied first. The upper cantilever arm 64 is then retracted upwardly to its home position, indicated in broken lines in FIG. 18. The sleeve sections 34, typically of tubular knitted fabric, normally are stretched snugly when being applied over the sleeve cones and are therefore self-holding after being loaded on the cones.

As soon as sleeve sections have been applied to both the sleeve cones 31, 32, the sleeve loader 30 is pivoted to a position, indicated in FIG. 16, in which the sleeve cones are axially aligned with and positioned directly above and below a vertically oriented body form 20 located at the sleeve insertion station I.

At the sleeve insertion station, a vertical support bracket 71 mounts the respective edge alignment frames 36, 37 at "home" positions just above and just below the ends of the vertically oriented body form 20. The alignment frames are secured to opposite reaches of a chain or belt 72, driven by a motor 73, enabling simultaneous vertical adjustment of the alignment frames. Thus, after an indexing movement of the turret brings a loaded, vertically oriented body form 20 to the sleeve insertion position I, the motor 73 is actuated to move the alignment frame simultaneously toward the center of the body form, to positions generally surrounding the outer end portions 27, 28 of the body form, substantially as shown in FIGS. 19 and 20, for example.

After positioning of the alignment frames in surrounding relation to the body form 20 (see FIG. 19) the sleeve cone support can be pivoted into alignment with the vertically oriented body form, with respective sleeve cones 31, 32 being positioned directly opposite and axially aligned with the opposite ends of the body form. Carried with the sleeve cones are tack pin assemblies 74, of which the upper pin assembly is shown in FIGS. 21, 22, it being understood that the tack pin assembly associated with the lower sleeve cone is of identical construction and function. The tack pin assembly includes a retractable rod 75 connected to an actuator 76. During the initial sleeve loading operations, the tack pin assembly is retracted into the end of the sleeve cone. When the sleeve cone is moved to a position aligned with a body form 20 at the sleeve insertion station I, the actuator 76 is operated to extend the rod 75 and advance a tack pin platform 77 into hollow end portions 78 of the body form. The tack pin platform carries a plurality of radially arranged retractable pin assemblies 79 which, in the illustration, are preferably radially spaced at angles of about 45°, providing eight pinning locations. Suitable holes or slots are provided in the hollow end portion 78 to enable the tacking pins 80 to be projected radially outward through the walls of the body form end portion.

After positioning of the tack pin assembly 74 in the manner shown in FIG. 20, the alignment frames 36, 37 are activated, and a plurality of sleeve opening positioners 81 are actuated. In the illustrated embodiment, there are eight such positioners 81, one aligned generally with each of the tack pin assemblies 79. Each positioner is spring urged toward the body form 20, to a limit position, shown in FIG. 20, in which a soft gripping element 82, mounted on an extendable positioner rod 83 is spaced slightly from the body form. As the positioners are actuated to extend, the gripping elements 82 engage the shirt material surrounding the end of the body form and slowly but steadily slide the fabric toward the center of the body form, causing the contoured edges 11 or 12 of the sleeve opening to be advanced toward a flat reference plane defined by the tack pins 80.

At the outer extremities of the body form, a reflective tape (not shown) is provided on the body form and cooperates with a light source/photocell control element 84, there being one such control element for each of the positioners 81 for independent control of each positioner. As the sleeve opening edge 11 or 12 approaches the level of the tack pins 80, the reflective tape is uncovered, and a reflection is sensed by the photocell control 84. This immediately stops further actuation of the positioner 81 and simultaneously causes actuation of the associated tack pin assembly 79. This action is taking place simultaneously and independently at eight different locations around each end of the body form and, when completed, will result in the contoured edges 11, 12 of the shirt body being held by the tack pins in general alignment with a predetermined reference plane defined by the tack pins. The several pin actuators 81 can then be fully retracted and the tack pin platforms 77 is retracted into the interior of the sleeve cones.

After positioning of the sleeve openings 11, 12 as above described, the respective sleeve sections are applied over the ends of the body form. To this end, the sleeve cones are of a segmented construction comprised of a plurality of cantilever supported, axially extending elements 85 (see FIG. 19). These elements are expanded radially, so that the sleeve cones and the sleeve sections contained thereon can be applied over the cylindrical end portions of the body form 20, by moving the sleeve cones simultaneously toward the support axis of the body form, substantially in the manner indicated in FIG. 22.

The sleeve sections are applied over the body form in their inside-out orientation, and with the hemmed edges of the sleeve applied first. With continued movement of the sleeve cones, eventually segments of the inner or contoured edges of the sleeve sections come into alignment with the several photocell sensors 84 mounted in the alignment frame and arrayed angularly about the body form. Associated with each photocell detector are upper and lower clamping actuators 86 (FIG. 23) each carrying soft gripping clamps 87. As in the case of the positioning devices 81, a pair of the clamping actuators 86 is associated with each photocell detector and is adapted for independent operation by the photocell. Thus, when the photocell detects a segment of the raw contoured edge (15, 16) of the sleeve section, the two clamping actuators 86 are immediately actuated to grip the sleeve in that region, and to hold the sleeve locally while the sleeve cone continues its advancing movement. When all eight of the clamping actuators 86 are in contact with the sleeve section, indicating alignment of the entire edge with the reference plane, the sleeve cone is withdrawn to a retracted position while the sleeve is held in place by the multiple clamping elements 87. As the sleeve cone is withdrawn, the knitted sleeve material, which is relatively elastic, contracts onto the body form 20, snugly surrounding the previously positioned shirt body material. At this stage, both the contoured sleeve openings 11, 12 of the shirt body and the edges 15, 16 of the sleeve sections are aligned with a predetermined reference plane at the end extremities of the body form. The fabric at this stage is self-holding on the body form, by reason of the elastic contraction of the sleeve sections around the end of the body form. Accordingly, the clamp actuators 86 can be retracted, and the alignment frames 36, 37 can be withdrawn from the ends of the body form to enable the body form to be indexed to the sewing station S.

At the sewing station S there is a sewing machine 119, which is mounted vertically. The sewing machine is mounted on a controllably rotatable table 88 driven by a motor 89 arranged to rotate the table and the sewing machine about an axis 90, which coincides with the axis of the vertically oriented body form 20.

To accommodate size adjustment, the sewing machine 86 is arranged to be adjusted vertically and also radially with respect to the axis of rotation 90. Vertical adjustment is effected by means of a platform 91 supported at four corners by screw shafts 92. These are all connected by a common belt 93 (FIG. 2) and driven by a motor 94. When the motor 94 is operated, all four threaded shafts are rotated simultaneously, such that the platform 91 is raised or lowered equally at all four corners, carrying with it the circular rotary table 88 and the sewing machine 119.

For body forms of different size, the sewing machine 119 may have to be adjustable radially inward or outward. For this purpose, the sewing machine is mounted on a platen 95 carried by the rotary table and which mounts the sewing machine for radial movement toward and away from the center axis 90, by means of a motor 96. Normally, the radial adjustment is set for a given body form.

When a body form 20, loaded with a shirt body and sleeves, is indexed into the sewing stations, the lift platform 91 is in a retracted (lowered) position. After the body form has completed its index movement, the lift platform is raised, by actuation of the lift motor 94. A member 97 on the sewing head engages the body form end 28, which is resiliently telescopically retractable into the main portion of the body form. As the lift platform continues to rise, the member 97 pushes the body form end upward, as indicated by the dotted line **28*a*, so that the body form is out of the way and the aligned fabric edges are exposed for sewing. The sewing machine 119 is then actuated, as is the motor 89 for driving the rotary platform 88. The sewing machine executes one or more complete sewing cycles, to secure the sleeve section to the sleeve opening of the shirt body. While the sewing machine continues to operate, the platform is lowered slightly, to tail off the stitching and allow the stitch chain to be severed. Thereafter, the lift platform is lowered sufficiently to allow the body form 20** to be indexed 180° to position the opposite sleeve in position to be sewn. The sewing cycle is then repeated for the second sleeve.

Figure 32:
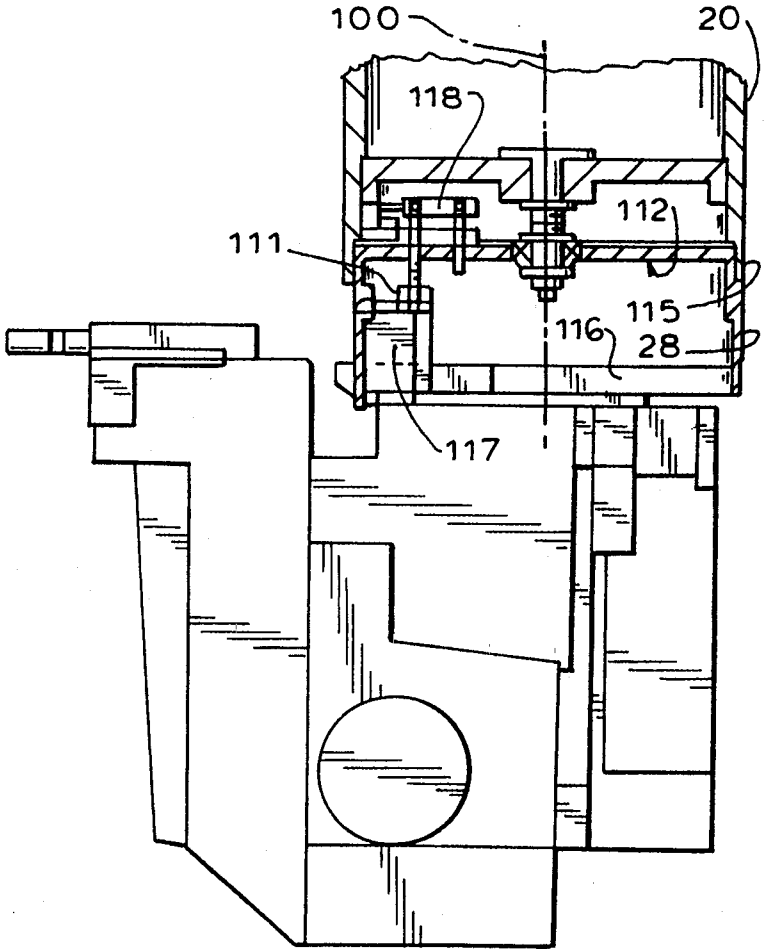
FIGS. 31 and 32 are fragmentary cross sectional views of an alternative version of shirt body form.
Figure 31:
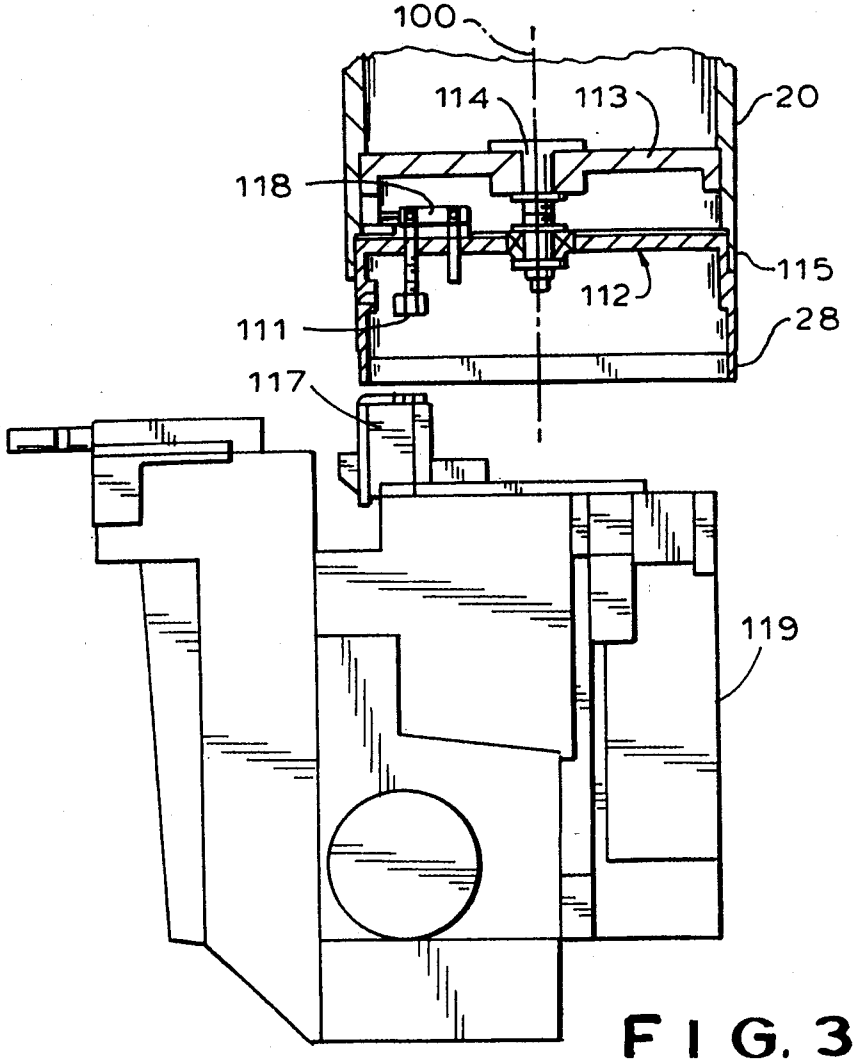
Figure 33:
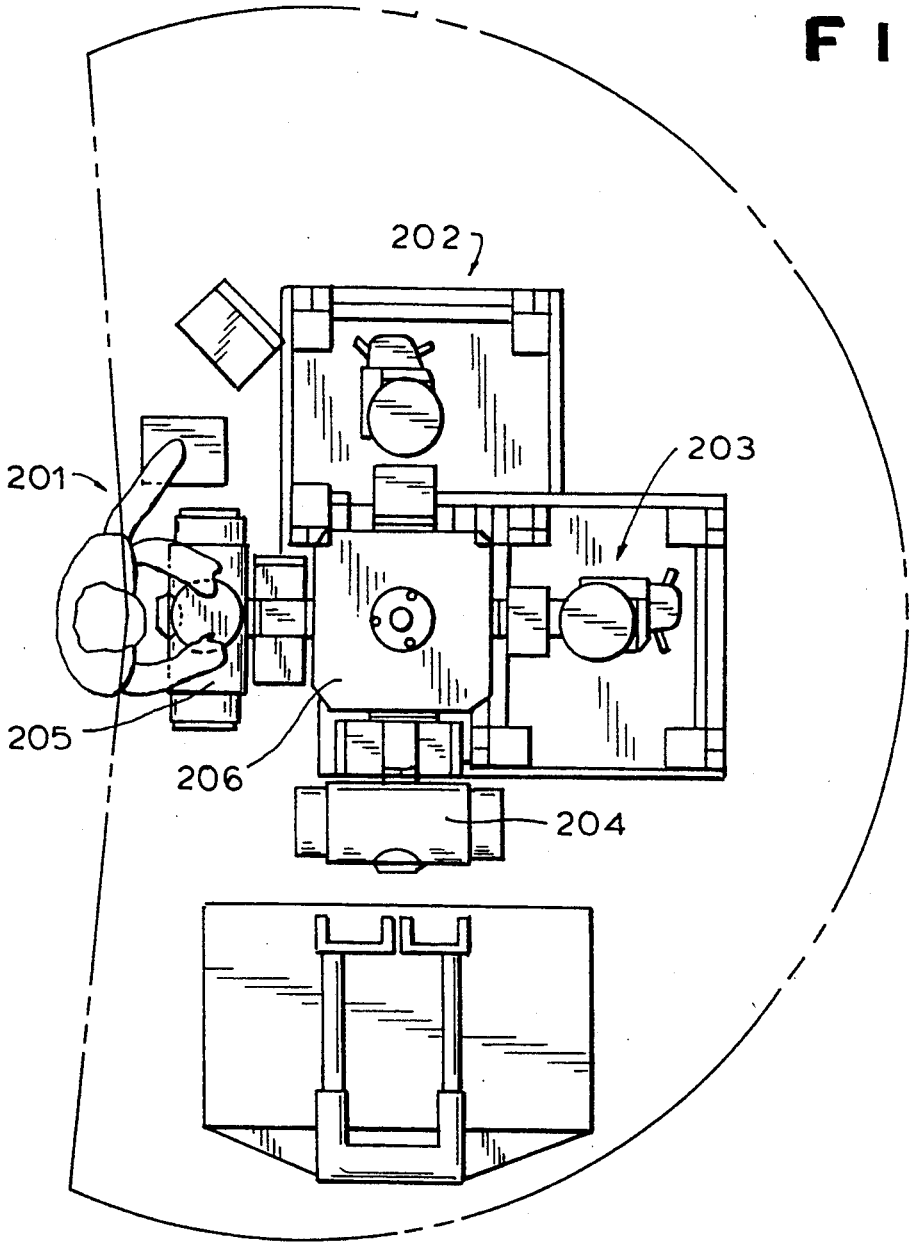
FIG. 33 is a simplified top plan view of a modified form of the method and apparatus of the invention, in which loading and alignment of the tubular sleeve sections is accomplished manually by the machine operator.
Figure 34:
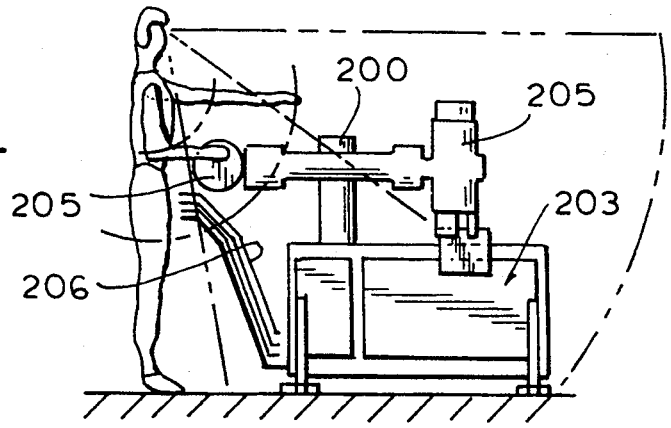
FIG. 34 is a side elevational view of the apparatus of FIG. 33.
Figure 35:
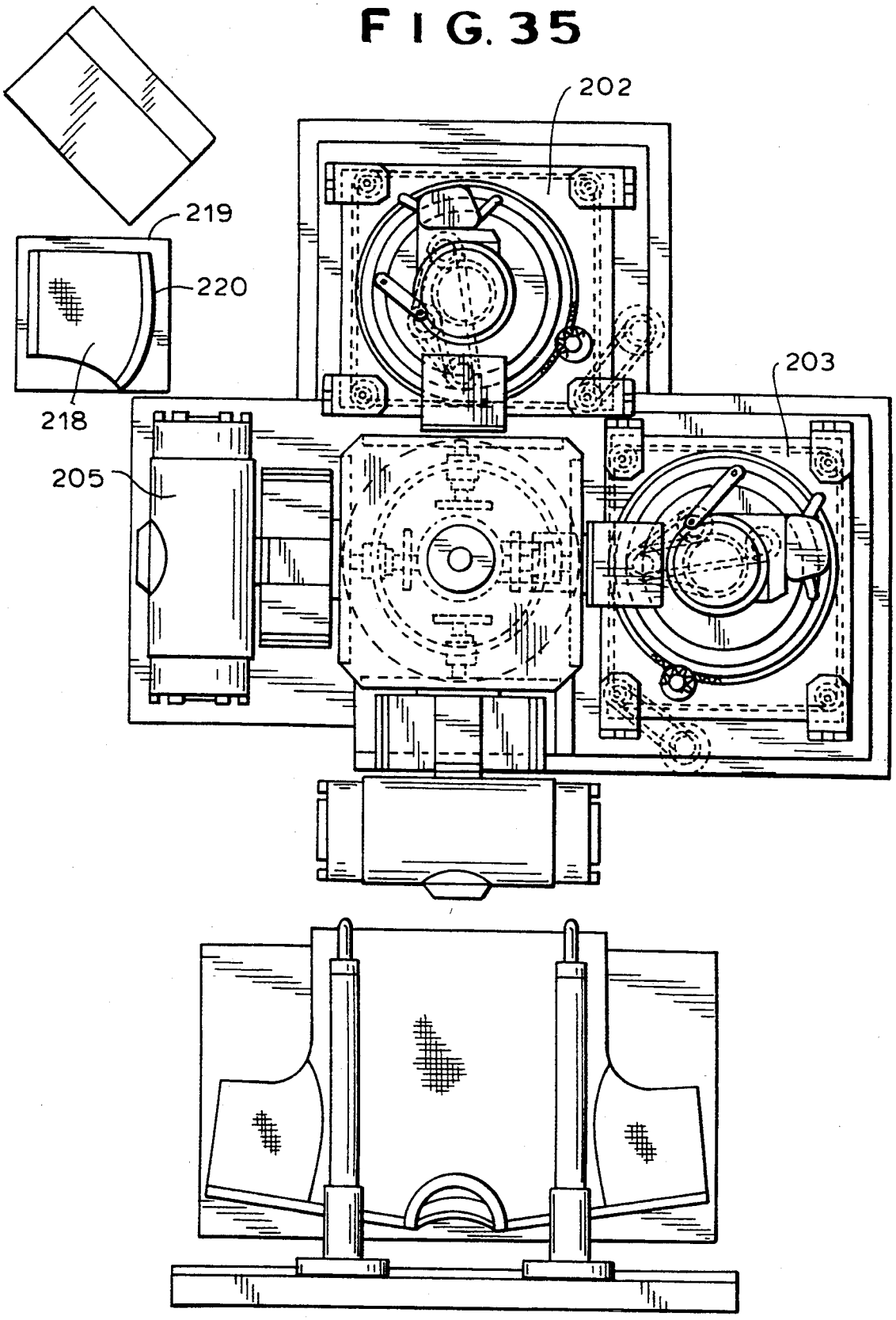
FIG. 35 is a top plan view, with parts removed, of the apparatus of FIG. 33.
Figure 36:
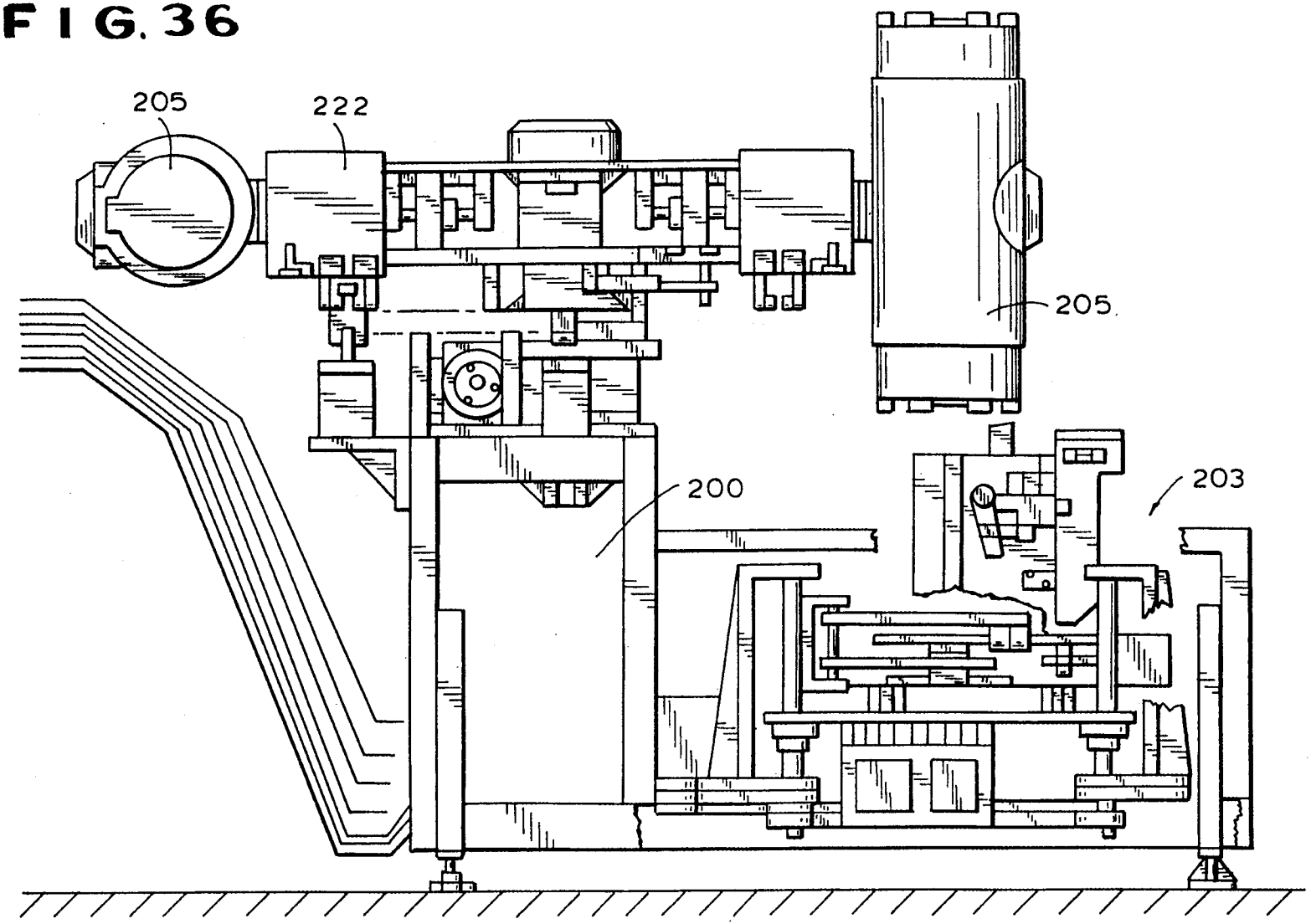
FIG. 36 is a side elevational view, similar to FIG. 34, showing additional details.

FIGS. 31 and 32 of the drawings illustrate a modification of the shirt body form, which can be used to advantage and which provides for rotation of the body form end sections, rather than telescopic retraction. The body form 20 has a recessed end wall 113 mounting a shaft 114 aligned with the center axis 110 of the body form. The shaft 114 rotatably mounts an end member 112 having outwardly extending cylindrical wall portions 115 and an extending cylindrical collar 116, the latter being fixed to and rotatable with the end member 112. The collar 116 and side wall 115 are notched at one side, in order to receive the platen 117 of the sewing head.

As reflected in FIG. 2, when a sewing head advances into the sewing position, the platen 117 engages a latch element 111, displacing a latch mechanism 118, which previously had been engaged with a fixed portion of the body form 20 to lock the rotary end member 112 in a fixed position. With the latch mechanism thus released, the end member 112 is free to rotate about the body form axis 110, as the sewing head executes its circular motion.

When the sewing head has executed a full circle and is retracted, the latch mechanism 118 reengages with the body form, as shown in FIG. 31, to lock the end member 112 against rotation.

To the extent that rotation of the end member 112 might otherwise tend to twist the overlying fabric, such tendency is neutralized by the action of the sewing machine feed dogs (not specifically shown, but conventionally provided on the sewing machine) provide a counteracting motion.

After completion of sewing, the turret 17 is indexed to advance the body form from the sewing station S to the unload station U. During this indexing movement, the cam groove 49 operates to rotate the body form to a horizontal orientation. In addition, when the indexing motion has been completed, the retracted cam actuator 60 is activated to lift the cam block 62 to a position level with the arcuate cam track 61. This serves to open the clamp elements 53, 54, in the manner illustrated in FIG. 13, freeing up the previously gathered tail section of the shirt body.

Because the insertion and sewing of the sleeve sections 13, 14 takes place while the sleeve sections have an inside-out orientation, and with the hemmed "outer" ends of the sleeve section located innermost with respect to the shirt body, the unloading operation is performed in two stages. In a first stage, the individual sleeve sections are turned outside-out. In a second stage, the shirt body is pulled off of the body form and deposited on the finished goods rack. This is accomplished in the system of the invention by means of a pair of picker arms 40, shown in FIGS. 29, 30, which are both telescopically extendable and laterally movable along a guide rail 98. The picker arms carry fabric picker elements 99 at their outer ends, adapted to engage and grip the fabric of the sleeve sections. As reflected in FIGS. 29, 30, when a body form 20 arrives at the unload station U, the picker arms 40 are moved laterally inward to positions substantially aligned with the hemmed "outer" edges 100 of the respective sleeve sections. The pickers are actuated to engage the sleeves at or adjacent the hemmed edges 100, after which the picker arms are actuated laterally outward, to positions shown in full lines in FIG. 30. In the process, the sleeve sections 13, 14 are turned outside-out and extended away from the shoulder portions of the shirt body, in a normal shirt configuration. Thereupon, the picker arms 40 are retracted, while still gripping the sleeve sections of the shirt, to draw the finished shirt off of the body form 20, depositing the finished shirt 41 on the platform 39 of the unload station.

After the finished shirt 41 is extracted from the body form at the unload station, the turret indexes the unloaded body form back to the load station L, where the operator applies a new shirt body and reloads the sleeve loader 30 for a new cycle of operations.

The relatively simple and compact apparatus of FIGS. 1–32 enables a high level of efficiency and economy to be imparted to the operation of attaching sleeves to tubular shirt bodies. A task which has heretofore been labor intensive and relatively costly is highly automated. The operator tasks are reduced to loading of the body section onto a body form, with only modest attention paid to alignment, and the loading of sleeve sections onto upper and lower sleeve cones. Once these simple tasks have been attended to, the remaining operations of inserting the sleeves, aligning the edges, sewing and unloading are all handled automatically without further operator attention. While these individual further operations are taking place, the operator sequentially loads empty body forms as they are successively indexed back to the load position after being stripped of finished shirts at the unload station.

An advantageous feature of the first-described form of the invention is the arrangement of the generally cylindrical body form to receive the shirt body and align the edges of the respective sleeve openings with respect to a predetermined reference plane. Thereafter, the sleeve sections are applied to the body form in an inside-out orientation and with the outer ends in, with respect to the sleeve body. After automatic, photocell alignment of the sleeve edges with respect to the reference plane, the sleeve sections are deposited on the body form, snugly surrounding the body form and thus being self-retaining in their aligned arrangements.

In an alternative version of the invention, illustrated in FIGS. 33–42, loading and alignment of the sleeve sections is performed manually by the machine operator, instead of automatically by the sleeve insertion mechanism of the first-described embodiment. While this results in some additional time involvement of the machine operator, experience indicates that a qualified machine operator can achieve performance levels that represent an acceptable trade-off to the additional cost of the automatic mechanisms for inserting sleeves.

As a general overview of the operation of the system of FIGS. 33–42, an advantageous form of apparatus incorporates a four-position, indexable turret mechanism 200 which may, in its general construction, be similar to that of the first-described embodiment. The arrangement provides for a load station 201, at which the machine operator performs the various load and alignment functions. The sleeve sections are inserted and aligned manually at the load station. Accordingly, the next turret station 202, which in the first-described embodiment is a sleeve loading station, can be employed as a sewing station. The next station 203 likewise can be employed as a sewing station, and the fourth position 204 serves as the unload station for the completed units.

At the loading station, the operator first applies sleeve sections over the opposite ends of the body form 205, aligning the "inner" edges of the sleeve sections with a reference plane adjacent the outer ends of the body form. Unlike the procedure of the first-described embodiment, where the sleeve sections are manually loaded, they are applied to the body form first and are applied with an outside-out orientation.

If desired, for convenience, the body form 205 may be oriented vertically in front of the operator to facilitate application and edge orientation of the sleeve section. After one sleeve section is applied, the body form can be rotated 180°, to present the opposite end of the body form at a convenient level for the operator to apply the second sleeve section and align its edges. The body form then preferably is rotated back to a horizontal orientation for loading of a shirt body. In some cases, it may be convenient to perform all of the loading operations, both sleeve sections and body section, while the body form 205 remains in a horizontal orientation.

For loading of the shirt bodies, the operator is provided with a supply 206 of shirt bodies on a suitable rack at the loading station, oriented with their tails nearest to the operator. The operator picks a shirt body off of the stack and applies it, tail first, over the body form 205, until the shoulders of the shirt body engage the body form. The operator then aligns the edges of the sleeve openings with the edges of the previously applied sleeve sections. In the case of the system of FIGS. 33–42, the shirt bodies are oriented inside out and loaded over the top of the previously loaded sleeve sections, which are oriented outside-out.

After a loading operation has been completed, the turret 200 is indexed to the next position. The just-loaded body form is rotated to a vertical orientation during the course of the indexing movement, so that one end of the body form is aligned with a sewing machine at the sewing station 202. A first sewing operation takes place at the station 202, attaching one of the sleeve sections to the shirt body by a circular motion of the sewing machine on its rotary platform. During the next indexing movement, the body form 205, in traveling from the first to the second sewing stations, is rotated 180°, so that the opposite end of the body form is presented to the second sewing machine at the second sewing station 203. The second sleeve section is secured at the station 203.

During the next indexing movement, the body form is rotated to a horizontal position, for unloading at the station 204.

The construction of the body form 205, and the construction of the sewing machines and platforms at the sewing stations 202, 203, are generally the same as those of the first-described embodiment and reference can be made to the earlier description for details.

Figure 37:
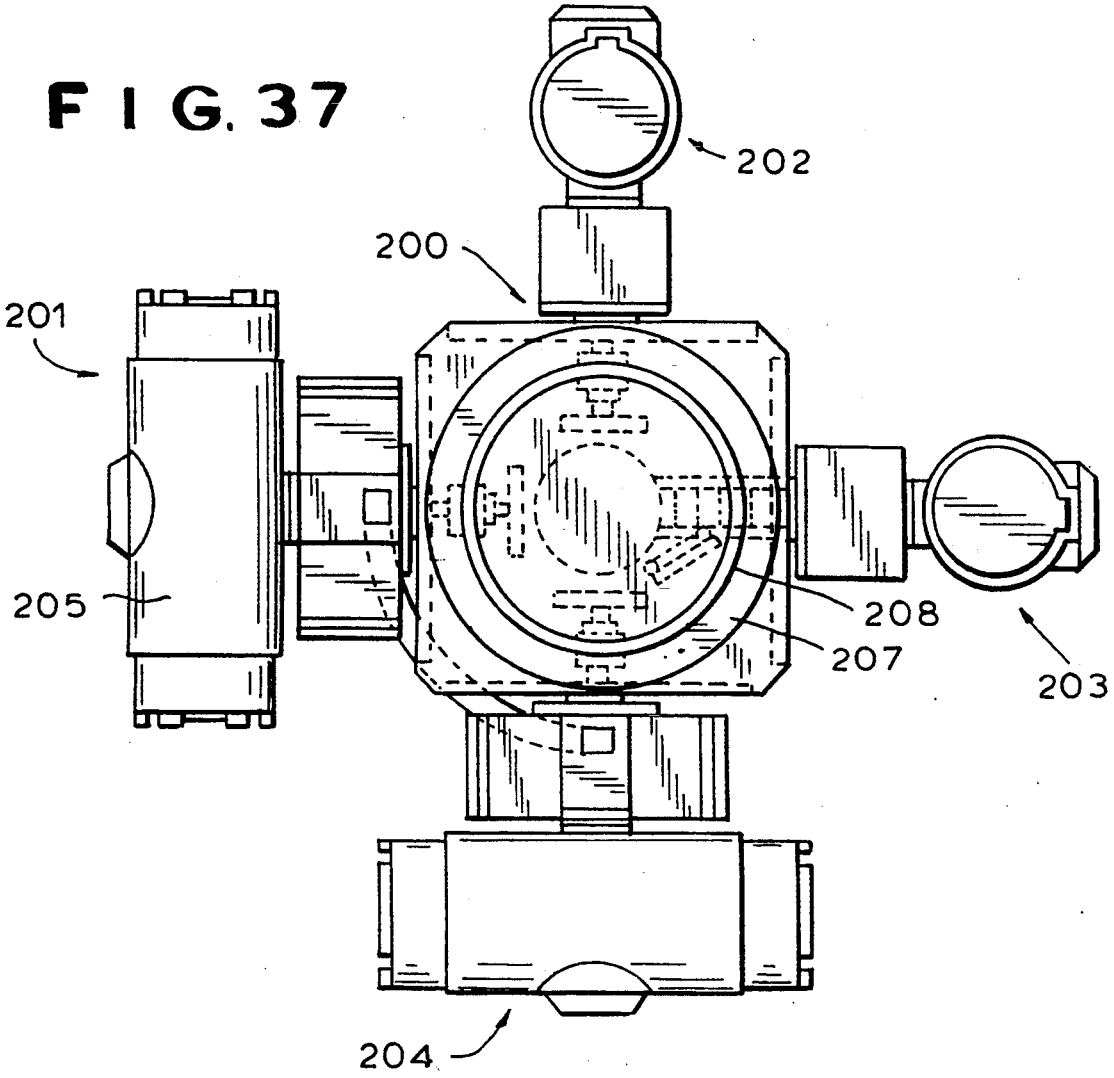
FIG. 37 is a top plan view of the turret mechanism and body form assemblies employed in the apparatus of FIG. 33.

As shown in FIG. 37, the turret apparatus 200 is provided with a fixed main cam 207 similar to the cam plate 48 of the first-described embodiment. The cam plate is provided with a contoured cam groove 208 which cooperates with a ball nut assembly 209 (see FIGS. 41, 42) formed with a cam follower 210 arranged to be received within the cam groove 208. The ball nut assembly 209 cooperates with a threaded portion 211 of a supporting shaft 212 on which the body form 205 is fixed. The contour of the cam groove 208 is such that, as the turret is indexed through 90° from the load station, a ball nut assembly is displaced radially as it advances from the load station 201 to the first sewing station 202. This causes the shaft and the body form 205 supported thereon to be rotated through 90° to a vertical orientation. Likewise, as the turret next indexes to advance a body form 205 from the first sewing station 202 to the second sewing station 203, the cam track displaces the ball nut assembly 209 radially a distance sufficient to rotate the shaft 211 and its mounted body form through 180°, presenting the opposite end of the body form to the sewing machine at the second sewing station 203. During the next indexing movement, the contour of the cam groove causes displacement of the ball nut to rotate the body form back to a horizontal position for unloading of the product at the unload station 204.

In order to manipulate the body form 205 at the load station, if desired, it is advantageous to provide a grooved barrel cam 213, which is mounted for rotation underneath the cam plate 207, partially projecting through an opening 214 therein opposite the load station. The barrel cam is provided with a spiral cam groove 215, one portion of which is aligned with the cam groove 208 in the main cam plate. When a ball nut assembly 209 is advanced to the loading station, its cam follower 210 enters an exposed portion 216 of the barrel cam groove. At this stage, the barrel cam may be rotated, as by means of a drive belt 217, to displace the ball nut assembly radially, rotating the shaft 212 and the body form 205 connected thereto. In this manner, the body form 205 may be manipulated rotationally as desired, to facilitate loading operations.

Figure 42:
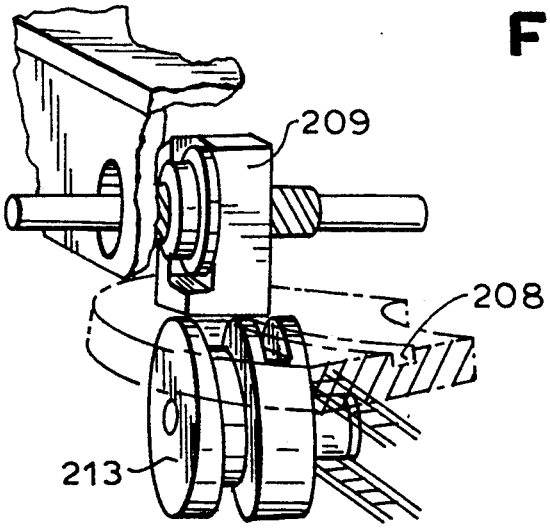

FIG. 42 illustrates the ball nut assembly 209 in a position displaced radially from the fixed cam groove 208, by means of rotation of the barrel cam 213. Normally, before the turret is further indexed, the ball nut assembly 209 is returned to alignment with the cam groove 208. However, it would also be possible to displace the cam groove 208 on the opposite side of the opening 214, so that further indexing could be commenced with the ball nut assembly 209 displaced from its incoming position.

In the illustrated form of the invention of FIGS. 33–42, two sewing stations are provided. However, a single sewing station could be utilized, if desired, generally in the same manner as with the first-described embodiment. In such cases, a barrel cam or other mechanism can be provided at the single sewing station, in order to effect a 180° rotation of the body form for successive sewing operations.

Figure 38:
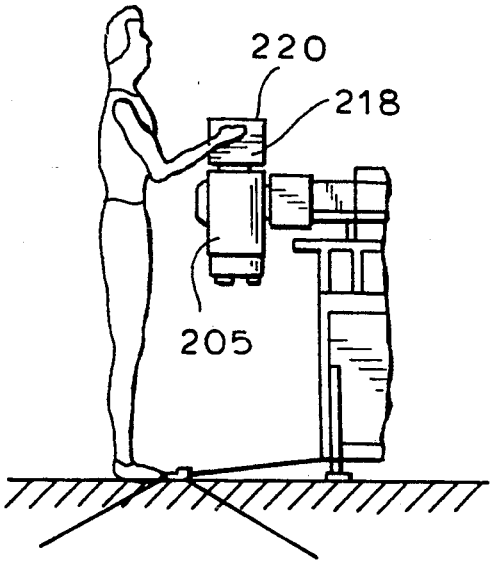
FIG. 38 is a fragmentary elevational view illustrating the manner in which an operator can load sleeve sections onto a body form apparatus of the system of FIG. 33.
Figure 39:
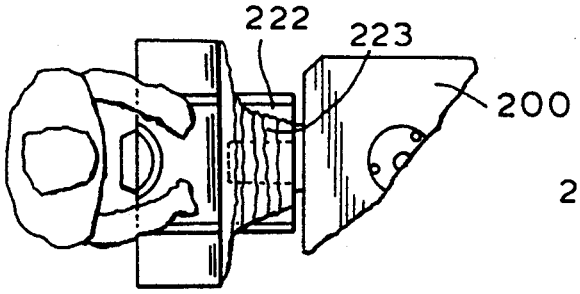
FIG. 39 is a fragmentary top plan view, showing an operator loading a shirt body onto the body form of the apparatus of FIG. 33.
Figure 40:
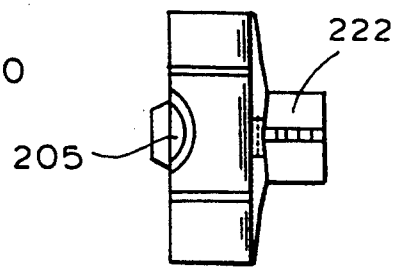
FIG. 40 is a fragmentary top plan view, showing a body form assembly with loaded sleeve sections and shirt body section.
Figure 41:
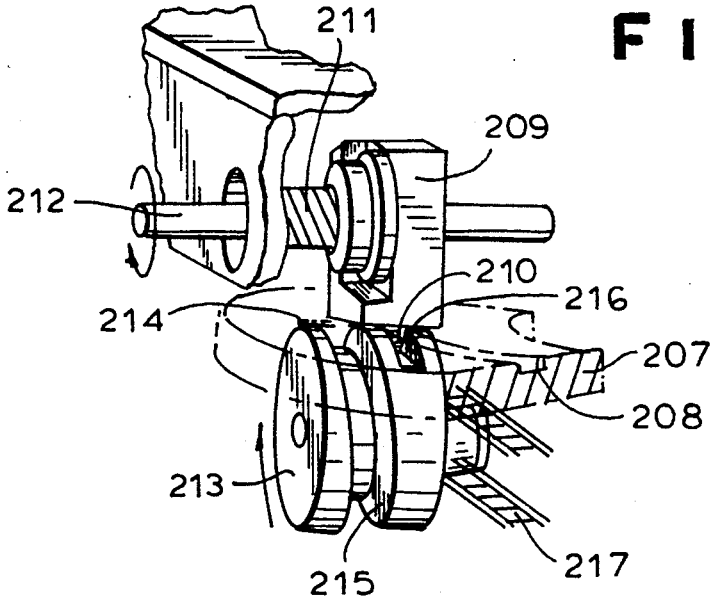
FIGS. 41 and 42 are simplified perspective representations illustrating and advantageous form of actuating mechanism employed in the apparatus of the invention.

FIG. 38 illustrates the use of vertical orientation of the body form 205 for loading of a tubular sleeve section 218. By operation of the barrel cam element 213, the body form is vertically oriented, with one end upward at a convenient height for the operator. A sleeve section 218, retrieved by the operator from a sleeve pallet 219 located adjacent to the load position (see FIG. 35), is applied over the upper end of the body form, with the contoured edge 220 of the sleeve section being properly oriented by the operator and aligned with a reference plane at the end edge of the body form. Once positioned, the sleeve section 218 remains as positioned, by reason of its elasticity, which causes it to hug the surface of the body form.

After a first sleeve section is mounted, the barrel cam 213 is actuated to rotate the body form to 180°, presenting the opposite end for loading and alignment of a second sleeve section. The barrel cam is then actuated again, to return the body form 205 to a horizontal orientation for convenient loading of the shirt body, in the manner shown in FIG. 39.

As in the case of the first-described embodiment, each turret position is provided with a clam shell clamp 222, which is open at the load station and receives the tail portion 223 of the shirt body, during loading by the operator. Before the turret is indexed to advance a body form from the load position, the clam shell clamp 222 associated therewith is closed, as reflected in FIG. 40, to confine the excess shirt body material within the clamp during the subsequent operations.

In either of the illustrated forms of the invention, the sleeve sections and body section are arranged on a contoured body form, with the sleeves in either overlapping or underlapping relation to the body section and with the overlapping section arranged in an inside-out orientation. The edges to be sewn are aligned adjacent the outermost edges of the body form, advantageously at a reference plane related at right angles to the main axis of the body form. Accordingly, even though the edges to be sewn are contoured, they may be sewn by circular movement of a sewing machine in a single plane. Successive sewing operations are carried out by presenting first one end of the body form to a sewing machine, and then rotating the body form through 180° to present the opposite end to a sewing machine. Consistent with the invention, either one or two sewing machines may be provided. Where a single sewing machine is utilized, the body form is presented to the sewing machine first in one orientation and then in the opposite (rotated 180°) orientation while at the same station. Where two sewing machines are employed, as in the embodiment of FIGS. 33–42, the body form is rotated 180° during an indexing movement of the main turret, such that one end of the body form is presented to the first sewing machine and the opposite end to the second sewing machine.

The method and apparatus of the invention significantly automates a heretofore highly labor intensive operation of sewing tubular sleeve sections onto the sleeve openings of tubular shirt bodies.

A particularly advantageous form of the invention, the body forms on which the sleeve sections and shirt bodies are mounted enable the edges to be sewn to be aligned in a single flat plane of circular configuration. The sewing machine or machines are mounted on a controllably rotatable platform, so as to be movable in a circular path adjustable to correspond exactly with the circular configuration of the seam to be sewn.

By aligning the contoured edges of the sleeve sections and the sleeve openings with respect to a flat reference plane, it is possible at the sewing station to execute a rapid circular sewing operation, securing each sleeve in succession to its respective sleeve opening in the shirt body.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A process for sewing tubular sleeves to tubular shirt bodies, which comprises (a) providing a tubular shirt body with contoured sleeve openings therein, (b) providing tubular sleeve sections having outer end edges and inner end edges for attachment to said shirt body at said openings, (c) applying said shirt body and said sleeve sections, snugly over a shirt body form having a central portion and opposite end portions, (d) supporting edges of said sleeve openings on said body form end portions, (e) positioning said tubular sleeve sections over the opposite end portions of said shirt body form, (f) one of said shirt body sleeve openings or said sleeve sections being in surrounding relation to the other, (g) the said one being arranged in an inside-out orientation, (h) aligning the inner end edges of said sleeve sections with the supported edges of said sleeve openings, and (i) while retaining said shirt body and said sleeve sections substantially in their thus aligned positions on said shirt body form, sewing said aligned edges together to secure each of the respective sleeve sections to its respective sleeve opening.

2. A process according to claim 1, further including (a) sewing said seams by positioning a sewing machine with its sewing head engaging overlapped edges of a sleeve opening and a sleeve section and advancing said sewing machine through a circular path about and generally concentric with end portions of said shirt body form.

3. A process according to claim 2, further including (a) aligning the edges of said sleeve openings and of said tubular sleeve sections with a predetermined reference plane, and (b) advancing said sewing machine through a circular path substantially at said reference plane.

4. A process according to claim 3, further including (a) axially aligning said body form with the axis of said circular path and with a first end of said form facing said sewing machine, for a first sewing operation, and (b) rotating said body form through 180°, about an axis at right angles to the axis of said circular path, in preparation for a second sewing operation.

5. A process according to claim 1, further including (a) during the sewing together of said aligned edges, moving end portions of said body form to expose said aligned edges on opposite sides for engagement by a sewing machine.

6. A process according to claim 1, further including (a) aligning the respective edges of said sleeve openings and said sleeve sections with respect to reference planes at each end of said body form, whereby said aligned edges may be sewn in a circular path.

7. A process according to claim 1, further including (a) mounting said sleeve sections on said shirt body form in an outside-out orientation, and (b) mounting said shirt body on said body form over said sleeve sections and in an inside-out orientation.

8. A process according to claim 7, further including (a) initially orienting said body form vertically with a first end up, while a first sleeve section is mounted on said first end, and (b) thereafter orienting said body form with an opposite end up while a second sleeve section is mounted on said opposite end.

9. A process according to claim 8, further including (a) orienting said body form horizontally, after mounting of said first and second sleeve sections, and (b) mounting a shirt body on said body form over said sleeve sections.

10. A process according to claim 7, further including (a) orienting said body form horizontally during mounting of said sleeve sections and said shirt body.

11. A process according to claim 1, further including (a) advancing said body form, after loading thereof with sleeve sections and a shirt body, successively from a loading station to a first sewing station, a second sewing station, and an unloading station, and (b) orienting said body form horizontally during at least a portion of the operations at said loading station, vertically during operations at said sewing stations, and horizontally at said unloading station.

12. An apparatus for automated attachment of tubular sleeve sections to pre-formed tubular shirt bodies, where the shirt bodies are formed with sleeve openings and the sleeve sections are formed with inner end edges adapted for attachment to edges of said sleeve openings, which comprises (a) a generally cylindrical body form for receiving and supporting a tubular shirt body, (b) said body form having a principal axis and having opposite end portions on said principal axis and of a size and location to be generally aligned with the sleeve openings of said shirt body, and of a size to snugly receive tubular sleeve sections generally concentric with said principal axis, (c) said body form end portions having generally cylindrical support surfaces for aligning and supporting edges of the sleeve openings with edges of the sleeve sections at the respective end portions of said body form, (d) a sewing machine positioned to sew together aligned and overlapped edge portions of said shirt body sleeve openings and said tubular sleeve sections, (e) rotary support means for mounting said sewing machine for circular motion corresponding to a generally circular configuration of said overlapped edge portions, (f) means for mounting said body form for rotation about a support axis at right angles to said principal axis, (g) means for rotating said body form about said support axis through 180°, to successively present opposite end portions of said body form for sewing of the overlapped edges supported thereon, (h) means for movably mounting said opposite end portions relative to said body form, and (i) means for controllably moving said end portions to provide access to both sides of said overlapped edges during sewing.

13. An apparatus according to claim 12, wherein (a) said end portions are rotatably mounted on said body form to be rotatable with said sewing machine.

14. An apparatus according to claim 13, wherein (a) latch means are provided to normally lock said end portions against rotation, and (b) said sewing machine has portions engageable with and operative to open said latch means to free said end portions for rotation during sewing.

15. An apparatus according to claim 12, wherein (a) said end portions are telescopically mounted on said body portion to be retractable with respect thereto.

16. An apparatus for automated attachment of tubular sleeve sections to pre-formed tubular shirt bodies, where the shirt bodies are formed with sleeve openings and the sleeve sections are formed with inner end edges adapted for attachment to edges of said sleeve openings, which comprises (a) a generally cylindrical body form for receiving and supporting a tubular shirt body, (b) said body form having end portions of a size and location to be generally aligned with the sleeve openings of said shirt body, and of a size to snugly receive tubular sleeve sections, (c) said body form having support surfaces for aligning and supporting edges of the sleeve openings with edges of the sleeve sections at the respective end portions of said body form, (d) a sewing machine positioned to sew together aligned and overlapped edge portions of said shirt body sleeve openings and said tubular sleeve sections, (e) an indexable turret mechanism mounting a plurality of body forms at radially spaced intervals, (f) said turret mechanism including means for rotatably supporting said body forms, (g) means for indexing said turret mechanism for successively advancing a body form from a loading station, to a sewing station, and finally to an unload station, (h) means for rotating a body form at the load station to a horizontal orientation to facilitate loading of a shirt body thereon, and (i) means for rotating a body form to a vertical orientation at a sewing station to enable ends of the body form to be accessed by said sewing machine.

17. An apparatus for automated attachment of tubular sleeve sections to pre-formed tubular shirt bodies, where the shirt bodies are formed with sleeve openings and the sleeve sections are formed with inner end edges adapted for attachment to edges of said sleeve openings, which comprises (a) a generally cylindrical body form for receiving and supporting a tubular shirt body, (b) said body form having end portions of a size and location to be generally aligned with the sleeve openings of said shirt body, and of a size to snugly receive tubular sleeve sections, (c) said body form having support surfaces for aligning and supporting edges of the sleeve openings with edges of the sleeve sections at the respective end portions of said body form, (d) a sewing machine positioned to sew together aligned and overlapped edge portions of said shirt body sleeve openings and said tubular sleeve sections, and (e) means associated with said body form for gathering and confining shirt material in a torso portion of the shirt body.

18. An apparatus according to claim 17, wherein (a) said means for gathering and confining comprises a pair of clam shell type clamping elements movable between open and closed positions, (b) said clamping elements, when in open positions, forming an upwardly open cavity for the reception of excess shirt material, and (c) said clamping elements, when in closed positions, confining said shirt material circumferentially.

19. An apparatus for automated attachment of tubular sleeve sections to pre-formed tubular shirt bodies, where the shirt bodies are formed with sleeve openings and the sleeve sections are formed with inner end edges adapted for attachment to edges of said sleeve openings, which comprises (a) a generally cylindrical body form for receiving and supporting a tubular shirt body, (b) said body form having end portions of a size and location to be generally aligned with the sleeve openings of said shirt body, and of a size to snugly receive tubular sleeve sections, (c) said body form having support surfaces for aligning and supporting edges of the sleeve openings with edges of the sleeve sections at the respective end portions of said body form, (d) a sewing machine positioned to sew together aligned and overlapped edge portions of said shirt body sleeve openings and said tubular sleeve sections, (e) said sewing machine being mounted for movement in a circular path about an axis generally coaxial with said generally cylindrical body form, (f) a rotary table for mounting said sewing machine and rotatable about an axis, for moving said machine through said circular path, and (g) a platform mounted for axial movement toward and away from an end of said body form, (h) said platform carrying said rotary table.

20. An apparatus according to claim 19, wherein (a) said sewing machine is mounted for radially adjustable positioning on said rotary table, for adjusting the radius of the circular path of movement of said sewing machine.

* * * * *